US006039425A

United States Patent [19]

Sekiya et al.

[11] Patent Number: 6,039,425

[45] **Date of Patent: *Mar. 21, 2000**

[54] INK JET RECORDING METHOD AND HEAD

[75] Inventors: Takuro Sekiya, Yokohama; Kyuhachiro Iwasaki, Fujisawa, both of Japan

[73] Assignee: Ricoh Company, Ltd., Tokyo, Japan

[ * ] Notice: This patent is subject to a terminal disclaimer.

[21] Appl. No.: 08/820,763

[22] Filed: Mar. 19, 1997

Related U.S. Application Data

[63] Continuation of application No. 08/480,148, Jun. 7, 1995, Pat. No. 5,657,060, which is a continuation of application No. 08/127,951, Sep. 27, 1993, Pat. No. 5,610,637.

[30] Foreign Application Priority Data

| | | | |
|---|---|---|---|
| Sep. 29, 1992 | [JP] | Japan | 4-259521 |
| Feb. 17, 1993 | [JP] | Japan | 5-28019 |
| May 7, 1993 | [JP] | Japan | 5-106706 |

[51] Int. Cl.[7] ..... B41J 2/04; B41J 2/015

[52] U.S. Cl. ..... 347/15; 347/10; 347/14; 347/57

[58] Field of Search ..... 347/10, 14, 15, 347/57

[56] References Cited

U.S. PATENT DOCUMENTS

| | | |
|---|---|---|
| 4,503,444 | 3/1985 | Tacklind . |
| 4,617,580 | 10/1986 | Miyakawa . |
| 4,740,796 | 4/1988 | Endo et al. . |
| 4,952,943 | 8/1990 | Iwata et al. . |
| 5,202,659 | 4/1993 | DeBonte et al. . |
| 5,252,986 | 10/1993 | Takaoka et al. . |
| 5,293,182 | 3/1994 | Sekiya et al. . |
| 5,389,962 | 2/1995 | Sekiya et al. . |
| 5,420,618 | 5/1995 | Sekiya et al. . |
| 5,610,637 | 3/1997 | Sekiya et al. ..... 347/15 |
| 5,657,060 | 8/1997 | Sekiya et al. ..... 347/15 |

FOREIGN PATENT DOCUMENTS

| | | |
|---|---|---|
| 259541 | 3/1988 | European Pat. Off. . |
| 476860 | 3/1992 | European Pat. Off. . |
| 56-9429 | 3/1981 | Japan . |
| 59-43312 | 10/1984 | Japan . |
| 59-207265 | 11/1984 | Japan . |
| 63-53052 | 3/1988 | Japan . |
| 2276648 | 11/1990 | Japan . |
| 3173654 | 7/1991 | Japan . |
| 3221456 | 9/1991 | Japan . |
| 4118245 | 4/1992 | Japan . |
| 550612 | 3/1993 | Japan . |

*Primary Examiner*—Huan Tran
*Attorney, Agent, or Firm*—Cooper & Dunham LLP

[57] ABSTRACT

An ink jet recording method includes the steps of inputting a set of driving pulses to a heater element so that the heater element is repeatedly activated by the driving pulses, repeatedly generating a bubble in ink in an ink path in accordance with repeated activation of the heater element, and separately jetting ink droplets from an ink jetting orifice due to the bubble repeatedly generated in the ink, a number of the ink droplets being equal to a number of the driving pulses input as a set to the heater element, the ink droplets jetted from the ink jetting orifice forming a single dot on a recording medium, wherein a time interval at which the driving pulses are input to the heater element is equal to or greater than 4T, T being a time period from a time at which the inputting of the pulses to the heater element starts to a time at which the bubble reaches a maximum size, and each ink droplet is a slender pillar so that a length of each ink droplet is at least three times as great as a diameter thereof. The present invention also relates to other ink jet recording methods and recording heads in which very small ink droplets can be stably jetted in a high frequency.

5 Claims, 19 Drawing Sheets

FIG. 1B

| DRIVING VOLTAGE (V) | PULSE WIDTH Pw (μs) | RATIO OF LENGTH (IL) TO DIAMETER (ID) (IL / ID) | FLYING VELOCITY Vi (m/s) | ACCURACY OF DOTTED POSITION ON RECORDING MEDIUM (DOT SIZE : 30μm) |
|---|---|---|---|---|
| 3.8 | 4 | 1.0 (SPHERICAL SHAPE) | 0.8 | WITHIN ± 10 DOTS |
| 3.9 | 4 | 1.5 (EGG SHAPE) | 2.7 | WITHIN ± 3 DOTS |
| 4.0 | 4 | 2.8 | 3.1 | WITHIN ± 2 DOTS |
| 4.1 | 4 | 3.1 | 5.2 | WITHIN ± 1/3 DOTS |
| 4.2 | 4 | 4.0 | 6.0 | WITHIN ± 1/3 DOTS |
| 4.3 | 4 | 4.8 | 7.6 | WITHIN ± 1/4 DOTS |
| 4.4 | 4 | 6.0 | 9.0 | WITHIN ± 1/4 DOTS |
| 4.5 | 4 | 8.1 | 9.4 | WITHIN ± 1/4 DOTS |
| 5.0 | 4 | 8.4 | 10.2 | WITHIN ± 1/4 DOTS |
| 6.0 | 4 | 9.5 | 11.9 | WITHIN ± 1/4 DOTS |
| 7.0 | 4 | 10.0 | 10.8 | WITHIN ± 1/4 DOTS |
| 8.0 | 4 | 9.9 | 11.5 | WITHIN ± 1/4 DOTS |

FIG. 5A

| ARRANGEMENT DENSITY OF ORIFICES (NUMBER / mm) | 8 | 16 | 24 | 48 |
|---|---|---|---|---|
| SIZE OF ORIFICE (μm) | 42 × 42 | 29 × 29 | 22 × 22 | 14 × 14 |
| SIZE OF HEATER ELEMENT (μm) | 56 × 336 | 28 × 168 | 20 × 112 | 12 × 56 |
| RESISTANCE OF HEATER ELEMENT (Ω) | 96 | 103 | 77 | 70 |
| DRIVING VOLTAGE (V) | 32 | 27 | 9 | 5 |
| PULSE WIDTH (μs) | 7 | 6 | 4.5 | 3 |
| TIME PERIOD UNTIL BUBBLE REACHES MAX. (μs) | 14.6 | 12.4 | 5.2 | 3.2 |
| TIME PERIOD UNTIL BUBBLE HAS DISAPPEARED (μs) | 44 | 37.5 | 15.7 | 9.5 |

FIG. 5B

| FREQUENCY OF PULSES (kHz) | ARRANGEMENT DENSITY OF ORIFICES 8/mm | ARRANGEMENT DENSITY OF ORIFICES 16/mm | ARRANGEMENT DENSITY OF ORIFICES 24/mm | ARRANGEMENT DENSITY OF ORIFICES 32/mm | ARRANGEMENT DENSITY OF ORIFICES 48/mm |
|---|---|---|---|---|---|
| 2 | DURABILITY $\geqq 10^9$ | DURABILITY $\geqq 10^9$ | DURABILITY $\geqq 10^9$ | DURABILITY $\geqq 10^9$ | DURABILITY $\geqq 10^9$ |
| 4 | DURABILITY $\geqq 10^9$ | DURABILITY $\geqq 10^9$ | DURABILITY $\geqq 10^9$ | DURABILITY $\geqq 10^9$ | DURABILITY $\geqq 10^9$ |
| 6 | DURABILITY $\geqq 10^9$ | DURABILITY $\geqq 10^9$ | DURABILITY $\geqq 10^9$ | DURABILITY $\geqq 10^9$ | DURABILITY $\geqq 10^9$ |
| 8 | BREAK AT $2.4 \times 10^6$ (5min) | DURABILITY $\geqq 10^9$ | DURABILITY $\geqq 10^9$ | DURABILITY $\geqq 10^9$ | DURABILITY $\geqq 10^9$ |
| 10 | | BREAK AT $9 \times 10^6$ (15min) | DURABILITY $\geqq 10^9$ | DURABILITY $\geqq 10^9$ | DURABILITY $\geqq 10^9$ |
| 20 | | | DURABILITY $\geqq 10^9$ | DURABILITY $\geqq 10^9$ | DURABILITY $\geqq 10^9$ |
| 30 | | | DURABILITY $\geqq 10^9$ | DURABILITY $\geqq 10^9$ | DURABILITY $\geqq 10^9$ |
| 40 | | | DURABILITY $\geqq 10^9$ | DURABILITY $\geqq 10^9$ | DURABILITY $\geqq 10^9$ |
| 50 | | | | DURABILITY $\geqq 10^9$ | DURABILITY $\geqq 10^9$ |
| 70 | | | | | DURABILITY $\geqq 10^9$ |

FIG. 5C

| FIRST HEAD (24/mm) | | | SECOND HEAD (32/mm) | | | THIRD HEAD (48/mm) | | |
|---|---|---|---|---|---|---|---|---|
| DRIVING VOLTAGE (V) | ENERGY RATIO E/S (J/cm²) | FLYING VELOCITY (m/s) | DRIVING VOLTAGE (V) | ENERGY RATIO E/S (J/cm²) | FLYING VELOCITY Vi (m/s) | DRIVING VOLTAGE (V) | ENERGY RATIO E/S (J/cm²) | FLYING VELOCITY Vi (m/s) |
| 4.8 | 0.278 | × | 3.7 | 0.253 | × | 3.4 | 0.253 | × |
| 4.9 | 0.290 | 2.6 ※ | 3.8 | 0.266 | 0.9 ※ | 3.5 | 0.268 | 1.1 ※ |
| 5.0 | 0.302 | 5.3 | 3.9 | 0.281 | 2.8 ※ | 3.6 | 0.283 | 3.0 ※ |
| 5.1 | 0.314 | 6.1 | 4.0 | 0.295 | 3.2 ※ | 3.7 | 0.299 | 3.9 ※ |
| 5.2 | 0.326 | 7.1 | 4.1 | 0.310 | 5.1 | 3.8 | 0.316 | 5.2 |
| 5.5 | 0.365 | 8.5 | 4.2 | 0.326 | 6.3 | 4.1 | 0.368 | 7.0 |
| 6.0 | 0.435 | 9.7 | 4.3 | 0.341 | 7.5 | 4.2 | 0.386 | 7.5 |
| 6.5 | 0.510 | 10.9 | 4.5 | 0.374 | 8.9 | 4.3 | 0.404 | 8.8 |
| 7.0 | 0.592 | 10.8 | 5.0 | 0.461 | 10.1 | 4.4 | 0.423 | 9.4 |
| 7.5 | 0.679 | 11.1 | 5.5 | 0.558 | 11.7 | 4.5 | 0.443 | 10.6 |
| 8.0 | 0.773 | 10.7 | 6.0 | 0.664 | 12.1 | 5.0 | 0.547 | 10.9 |
| 9.0 | 0.978 | 10.6 | 7.0 | 0.904 | 12.2 | 5.5 | 0.661 | 11.5 |
| 10.0 | 1.21 | 11.0 | 8.0 | 1.18 | 12.0 | 6.0 | 0.787 | 11.9 |
| 11.0 | 1.46 | 11.4 | 9.0 | 1.49 | 10.9 | 6.5 | 0.924 | 12.4 |
| 12.0 | 1.74 | 11.5 | 10.0 | 1.85 | 10.7 | 7.0 | 1.07 | 11.8 |
| 13.0 | 2.04 | 11.2 | 10.5 | 2.03 | 11.5 | 7.5 | 1.23 | 10.7 |
| 13.5 | 2.20 | 11.3 | 11.0 | 2.23 | 11.1 | 8.0 | 1.40 | 11.3 |
| 14.0 | 2.37 | 12.1 | 11.5 | 2.44 | 12.3 | 9.0 | 1.77 | 10.9 |
| 14.5 | 2.54 | 12.2 | 12.0 | 2.66 | 11.4 | 10.0 | 2.19 | 11.3 |
| 15.0 | 2.72 | 11.5 | 12.5 | 2.88 | 11.2 | 10.5 | 2.41 | 11.5 |
| 15.5 | 2.90 | 10.9 | 12.6 | 2.93 | 11.1 | 11.0 | 2.65 | 11.9 |
| 15.6 | 2.94 | 10.9 | 12.7 | 2.98 | 11.2 | 11.5 | 2.89 | 11.6 |
| 15.7 | 2.98 | 11.2 | 12.8 | 3.02 | 11.5 | 11.6 | 2.94 | 11.8 |
| 15.8 | 3.01 | 11.0 | 12.9 | 3.07 | HEATER WAS BROKEN | 11.7 | 2.99 | 12.1 |
| 15.9 | 3.05 | 11.1 | | | | 11.8 | 3.04 | 11.4 |
| 16.0 | 3.09 | 11.3 | | | | 11.9 | 3.10 | HEATER WAS BROKEN |
| 16.1 | 3.13 | HEATER WAS BROKEN | | | | | | |

※ : SPHERICAL SHAPED INK DROPLETS UNSTABLY FLY AT LOW VELOCITY

| MASS OF INK (g) | DOT SIZE ON RECORDING MEDIUM (A) | DOT SIZE ON RECORDING MEDIUM (B) | DOT SIZE ON RECORDING MEDIUM (C) |
|---|---|---|---|
| ONE DROPLET $1.405 \times 10^{-8}$ | 50.3 ($\mu$m) | 50.4 ($\mu$m) | 55.6 ($\mu$m) |
| FIVE DROPLETS $7.025 \times 10^{-8}$ | 120.7 | 122.0 | 157.9 |
| TEN DROPLETS $1.405 \times 10^{-7}$ | 163.0 | 171.9 | 198.3 |

INK JET RECORDING METHOD AND HEAD

This is a continuation of application Ser. No. 08/480,148 filed Jun. 7, 1995, U.S. Pat. No. 5,657,060 which is a continuation of Ser. No. 08/127,951 filed Sep. 27, 1993 U.S. Pat. No. 5,610,637.

BACKGROUND OF THE INVENTION (1) Field of the Invention

The present invention generally relates to an ink jet recording method and head, and more particularly to an ink jet recording method and head in which a dot is recorded using one or a plurality of ink droplets so that the size of the dot is controlled.

(2) Description of the Related Art

A non-impact recording method is advantageous since a noise level generated during a recording process is low enough to be ignored. Particularly, an ink jet recording method, which is one example of the non-impact recording method, can make prints at a high velocity and can make prints on normal sheet without an image fixing process. Since, the ink jet recording method is a very useful recording method, printers using the ink jet recording method have been proposed and have been put into practical use.

In such an ink jet recording method, droplets of recording liquid named as ink are jetted, the ink droplets are adhered to the recording medium and images are formed on the recording medium by the adhered ink droplets. The ink jet recording method is disclosed, for example, in Japanese Patent Publication No.56-9429. In the method disclosed therein, a bubble is generated in the ink in a liquid chamber by heating the ink so that pressure in the ink is increased. The ink is then jetted, as an ink droplet, from a fine orifice at the lead end of a nozzle and an ink dot is recorded on the recording medium.

Various method have been proposed based on the above principle of the ink jet recording method. For example, Japanese Laid Open Patent Application No.59-207265 discloses a method by which-gray scale images are recorded. In this method, a sequence of pulses is supplied to a heater so that ink droplets are generated, a single droplet into which the generated ink droplets are connected is jetted to a recording medium, and a single dot is formed on a recording medium. The number of the generated ink droplets is controlled in accordance with the number of pulses included in a sequence of pulses.

A method disclosed in Japanese Laid Open Patent Application No.63-53052 has been known. In this method, a gray scale image is recorded by jetting a sequence of ink droplets which are to be fused into a single dot on a recording medium within a wet time of the recording medium. That is, ink droplets are separately jetted at a high velocity a recording medium, and the ink droplets are then fused into a single dot on the recording medium within the wet time of the recording medium. The size of the dot on the medium corresponds to the number of ink droplets fused into the single dot within the wet time of the recording medium.

Further, a method disclosed in Japanese Patent Publication No.59-43312 has been known. In this method, to improve the output responsibility and stability of ink droplets in response to pulses supplied to a heater to generate bubbles in the ink, an input interval of the pulses in the maximum frequency at which ink droplets are generated is controlled so as to be as large at least three times as the half-width of each pulse.

In the method disclosed in Japanese Laid Open Application No.59-207265, to maintain a condition in which a plurality of jetted ink droplets are connected together to form a single ink droplet, the ink droplets must be jetted at a low velocity. However, if the droplets are jetted at the low velocity, a locus in which each droplet is jetted is not stable, so that deterioration in the quality of prints occurs. In addition, the ink droplets jetted at the low velocity are easily affected by the malfunction of the ink jet recording head and the variation in the moving velocity of the recording head. If the ink jet recording head is moved at a high velocity, a true circular dot is not made on the recording medium when the jetted ink droplets are adhered to the recording medium. As a result, an image formed on the recording medium does not become clear.

Japanese Laid Open Patent Application No.63-53052 does not disclose conditions under which ink drops are-to be jetted other than only a condition in which a time interval separating the activation of the heater to jet the next ink droplet from the disappearance of the bubble falls within a range between 0.1 microsecond and 1.0 millisecond. Thus, it can not be understood under what conditions ink droplets are to be jetted nor how the recording head to be used is to be structured, so that the method can not be realized.

Japanese Patent Publication No.59-43312 describes only conditions under which ink droplets can be stably jetted by an on-off operation of a pulse signal. That is, the gray scale printing method is not disclosed in Japanese Patent Publication No.59-43312, but discloses only conditions for a stable binary printing operation.

SUMMARY OF THE PRESENT INVENTION

Accordingly, a general object of the present invention is to provide a novel and useful ink jet recording method and head in which the disadvantages of the aforementioned prior art are eliminated.

A more specific object of the present invention is to provide an ink jet recording method and head in which a dot size is controlled in accordance with image density information so that gray scale recording of images can be performed.

Another object of the present invention is to provide an ink jet recording method and head in which very small ink droplets can be formed by infinitesimal amount of energy and the gray scale recording of images can be performed by controlling the number of ink droplets so that the dot size is controlled.

Another object of the present invention is to provide an ink jet recording method and head in which the very small ink droplets can be stably jetted at a high frequency.

The above objects of the present invention are achieved by an ink jet recording method for jetting ink droplets from an ink jet recording head to a recording medium and forming a dot image on the recording medium, the ink jet recording head having an ink chamber for storing ink, an ink jetting orifice, an ink path connecting the ink chamber and the ink jetting orifice and a heater element provided in the ink path, the ink jet recording method, comprising the steps of: (a) inputting a set of pulses to the heater element so that the heater element is repeatedly activated by the driving pulses, a number of pulses in the set depending on image information supplied from an external unit; (b) repeatedly generating a bubble in the ink in the ink path in accordance with repeated activation of the heater element; and (c) separately jetting ink droplets from the ink jetting orifice by repeatedly generating the bubble in the ink, a number of the ink droplets being equal to a number of the driving pulses input as a set to the heater element in step (a), the ink droplets jetted from the ink jetting orifice forming a single dot on the recording medium, wherein a time interval at which the driving pulses are input to the heater element is equal to or greater than 4T, T being a time period from a time at which the inputting of the pulses to the heater element starts to a time at which the bubble reaches a maximum size, and each ink droplet is a slender pillar so that a length of each ink droplet is at least three times as great as a diameter thereof.

The above objects of the present invention are also achieved by an ink jet recording head for jetting ink droplets to a recording medium and forming a dot image on the recording medium, the ink jet recording head comprising: an ink chamber for storing ink; an ink jetting orifice from which ink droplets are jetted; an ink path connecting the ink chamber and the ink jetting orifice; and a heater element provided in the ink path, a set of pulses being supplied to the heater element so that the heater element is repeatedly activated by the driving pulses, a bubble being repeatedly generated by the activation of the heater element, the ink droplets being jetted from the ink jetting orifice by the bubble being repeatedly generated, and the jetted ink droplets forming a single dot on the recording medium, wherein an energy E of each pulse falls within a range of $0.6\times10^{-6}$–$14.8\times10^{-6}$ (joule), an area S of the ink jetting orifice falls within a range of $2\times10^{-6}$–$5\times10^{-6}$ ($cm^2$) and a ratio E/S falls within a range of 0.3–3.

According to an ink jet recording method of the present invention, as the ink droplets are separately jetted and each dot is a slender pillar, a fine flying locus of each ink droplet is obtained and a flying velocity of each ink droplet is stable. Thus, a dot image having a high quality can be obtained. In addition, according to an ink jet recording head of the present invention, small ink droplets can be stably jetted from each ink jetting orifices.

Additional objects, features and advantages of the present invention will become apparent from the following detailed description when read in conjunction with the accompanying drawings.

BRIEF DESCRIPTION OF THE DRAWINGS

FIG. 1B is a table indicating a relationship between the shape of the ink droplet and flying velocity of the ink droplet and a relationship between the shape of the ink droplet and variation of recording position.

FIG. 5A is a table indicating generating profiles of ink droplets in various type of ink jet recording heads.

FIG. 5B is a table indicating the durability of various types of ink jet recording heads.

FIG. 5C is a table indicating the relationship between the energy supplied to a heater element and the flying velocity of ink droplets in various types of ink recording heads.

DESCRIPTION OF THE PREFERRED EMBODIMENTS

Figure 17:
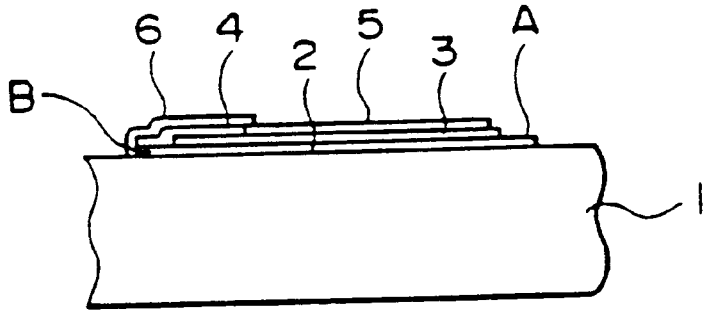
FIG. 17 is a cross sectional view showing heater base plate of the ink jet recording head.
Figure 18A:
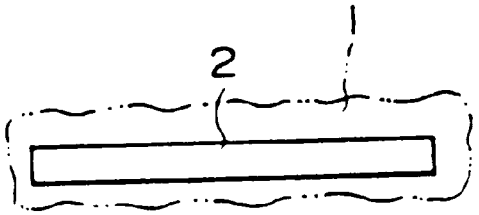
FIG. 18 in parts (*a*), (*b*), (*c*) and (*d*) is diagram illustrating a procedure in accordance with which the heater base plate is formed.
Figure 18B:
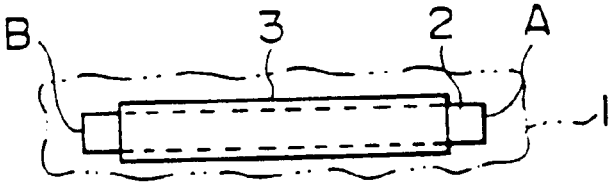
Figure 18C:
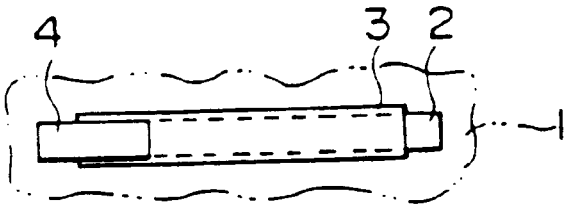
Figure 18D:
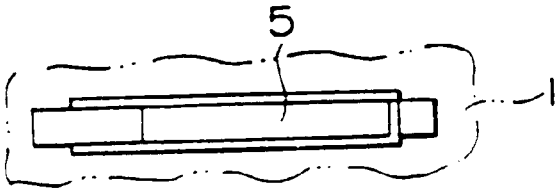

A description will now be given of a first embodiment of the present invention. FIG. 17 shows an example of a heater base plate used in an ink jet recording head according to the first embodiment of the present invention.

Referring to FIG. 17, a first electrode 2, an insulating layer 3, a heater element 4, a second electrode 5 and a protection layer 6 are successively stacked on a base 1. An end (A) of the first electrode 2 is a portion to which a lead wire is to be connected, and another end (B) of the first electrode 2 is connected to an end of the heater element 4.

The structure of the heater base plate shown in FIG. 17 is formed in accordance with a procedure as shown in FIGS. 18 (*a*), (*b*), (*c*) and (*d*).

First, the first electrode 2 is formed on the base 1 as shown in FIG. 18 (*a*). The first electrode 2 is then covered by the insulating layer 3 so that both end portions (A) and (B) of the first electrode 2 project from the insulating layer 3, as shown in FIG. 18 (*b*). The heater element 4 is formed on a part of the insulating layer 3 and on the end portion (B) of the first electrode 2, as shown in FIG. 18 (*c*). After this, the second electrode 5 is formed on the insulating layer 3 so as to be in contact with the heater element 4 as shown in FIG. 18 (*d*).

The first and second electrodes 2 and 5 are made of material such as Al or Au. A metal layer is formed by an evaporation process, a sputtering process, a plating process, or the like, and the metal layer is then patterned by the photo-lithography process so that each of the first and second electrodes 2 and 5 is formed. The insulating layer 3 is made of material such as $SiO_2$ or $Si_3N_4$ and is formed in the same manner as the electrodes 2 and 5. The heater element 4 is made of material such as tantalum nitride, nichrome or hafnium boride.

To simplify, the minimum structure of the heater base plate has been described above. Each of the first and second electrodes 2 and may have a double layer structure in which a first layer made of Al or Au is formed by the evaporation process and a second layer made of Au is formed on the first layer by the plating process. The insulating layer 3 may have the multilayer structure. The base 1 may be provided with a regenerative layer to prevent heat from diffusing.

Figure 19:
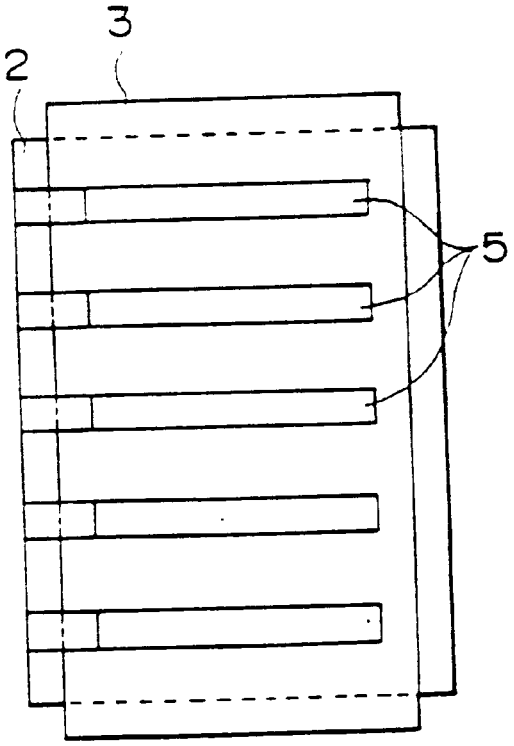
FIG. 19 is a diagram illustrating a modification of the heater base plate.

FIG. 19 shows another example of the heater base plate. In this heater base plate, the first electrode 2 is connected to a plurality of the heater elements 4 in contact with the second electrodes 5. That is, the first electrode 2 is used as a common electrode of the heater elements 4.

The applicant made the heater base plate in which heater elements 4 were arranged at a density of 48/mm (corresponding to a dot density of 1200 idp (dots per inch)). The total number of heater elements 4 formed in this heater base plate was 256.

Figure 20:
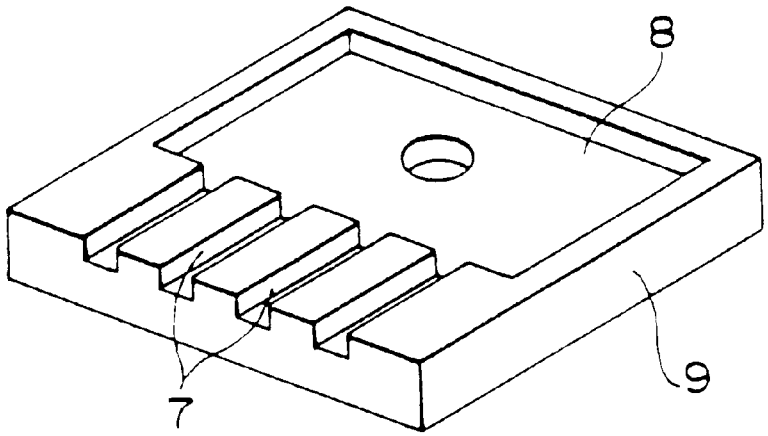
FIG. 20 is a perspective view showing a lid base.

To obtain an ink jet recording head having liquid paths through which the ink flows and nozzles, the heater plate base described above may be connected to a lid plate having grooves 7 and a concave portion 8 as shown in FIG. 20. In this embodiment, since the nozzles and the liquid paths must be arranged at a high density such as a density of 24/mm, 32/mm or 48/mm, the ink jet recording head having a fine structure is made by the photo-lithography process.

A description will now be given, with reference to FIGS. 21–28, of an example of the ink jet recording head made by the photo-lithography process.

Figure 21:
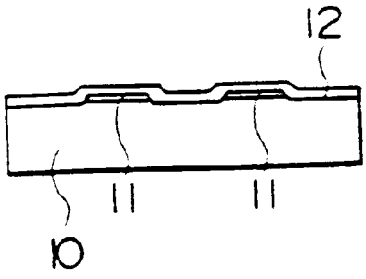
FIG. 21 is a front view illustrating the heater base plate of the ink jet recording head.

FIG. 21 shows the heater base plate having a base 10, heater elements 11 and a thin film 12. In a step for forming the heater base plate shown in FIG. 21, the heater elements 11 are formed on the base 10 made of material such as Si, glass or ceramic so as to be arranged at a predetermined intervals. To improve the ink-proof and the electrical insulating ability of the heater base plate, the thin film 12 made of material such as $SiO_{21}$ $Ta_2O_5$ or glass is formed on the base 10 so as to cover the heater elements 11 as the need arises. The heater 11 is connected with electrodes (not shown) to which pulses are to be supplied.

Figure 22:
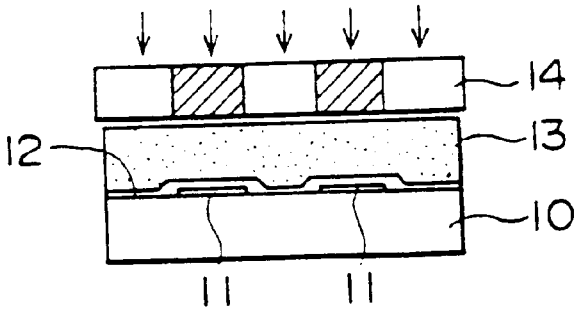
FIG. 22 is a diagram illustrating a step for forming a groove for making the ink flow onto the heater base plate.

In a step shown in FIG. 22, after rinsing the surface of the thin film 12 obtained in step shown in FIG. 21 and drying it, a liquid photoresist is coated on-the thin film 12 by a spin-coating process, and a pre-baking of the structure is performed, for example, at 80° C. for 30 minutes. The photoresist can be also coated by a roller coating process or a dip coating process. In this case where high density patterns must be formed, a dry film photoresist is not suitable. Patterns can be formed using the dry film photoresist at a density of 16/mm, but it is difficult to form patterns having a density greater than 16/mm using the dry film photoresist. In the present invention, the liquid photoresist BMRS-1000 (manufactured by TOKYO OHKA KOGYO CO., LTD.) was used. Due to controlling the number of revolutions within a range 500–2500 rpm in the spin coating process, the thickness of the photoresist layer 13 formed on the thin film 12 could be varied within a range 7–30 $\mu$m.

After this, a photomask 14 having a predetermined mask pattern is stacked on the photoresist layer 13, and the exposure process is then performed such that lights are projected onto the photomask 14. In this step, the photomask 14 is set on the photoresist layer 13 by the well known method so that the mask pattern faces the heaters 11.

Figure 23:
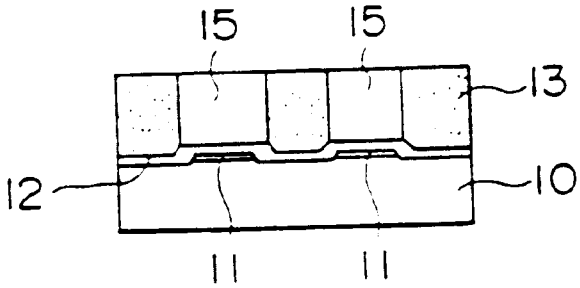
FIG. 23 is a diagram illustrating the heater base plate on which the groove is formed.

In step shown in FIG. 23, parts of the photoresist layer 13 onto which the lights were not projected in the exposure process are removed by a developer including a organic solvent such as trichloroethan. As a result, grooves 15 are formed over the heaters 11. After this, to improve the ink-proof of the photoresist layer 13 remained on the thin film 12 after the exposure process, the structure shown in FIG. 23 is heated, for example, at a temperature within a range of 150–250° C. for a time within a range of 30 minutes–6 hours (a thermohardening process), and/or ultraviolet rays (e.g. 50–200 mW/cm$^2$ or more) are projected onto the photoresist layer 13. As a result, the polimerization hardening reaction proceeds in the photoresist layer 13, and the photoresist layer 13 is hardened.

Figure 24:
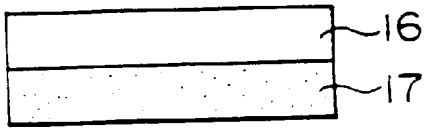
FIG. 24 is a diagram illustrating the lid base.

FIG. 24 shows a lid base for covering the structure having the photoresist layer 13 in which the grooves 15 and concave portions (not shown) are formed as shown in FIG. 23. A dry film photoresist 17 is laminated on a surface of a plate 16 made of material through which electromagnetic waves, for example, ultraviolet rays can pass. The dry film photoresist 17 is laminated on the surface of the plate 16 using a laminator on the market such that air bubbles are not inserted into between the plate 16 and the dry film photoresist 17. In this invention, the dry film photoresist SY-325 (manufactured by TOKYO OHKA KOGYO CO., LTD) was used.

Figure 25:
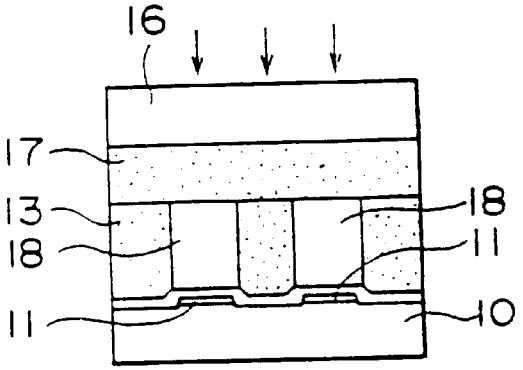
FIG. 25 is a diagram illustrating the heater base plate and the lid base both of which are pressed against each other and made adhere to each other.

In step shown in FIG. 25, the dry film photoresist 17 of the lid base shown in FIG. 24 and the photoresist layer 13 of the heater base plate shown in FIG. 23 are pressed against each other and made adhere to each other. In this step, the ultraviolet rays (e.g. 50–200 mW/cm$^2$ or more) are projected onto the dry film photoresist 17 via the plate 16 so that the dry film photoresist 17 is sufficiently hardened. Further the thermohardening process (e.g. 130–250° C., 30 minutes–6 hours) may be carried out.

Figure 26:
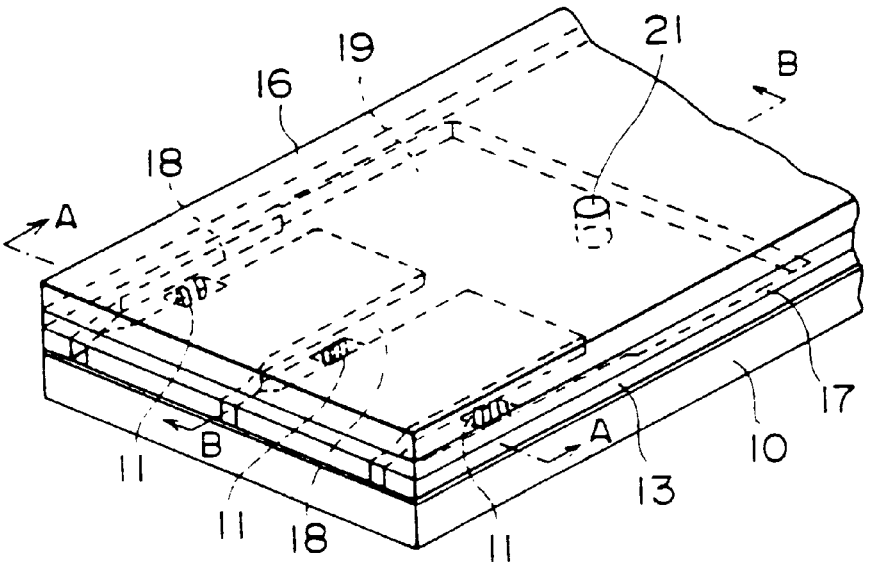
FIG. 26 is a perspective view showing a structure formed of the heater base plate and the lid base both of which are made adhere to each other.

When step shown in FIG. 25 is completed, the structure is formed as shown in FIG. 26. In the structure shown in FIG. 26, the grooves 15 and the concave portion are respectively covered by the lid base, so that liquid paths 18 and a liquid chamber 19 are formed. On the lid base, an inlet 21 is formed to which an ink supply tube 20 (shown in FIG. 28) for supplying the ink to the ink chamber 19 is to be connected. The leading end portion of the structure is cut along line A—A, and the section is smoothed, so that ink jetting orifices 22 (shown in FIG. 28) are formed at the ends of the ink paths 18. Further, the ink supply tube 20 is connected to the inlet 21, and the ink jet recording head is completed. The leading end of the structure is cut along the line A—A by a dicing method used in a normal semiconductor production process so that the distance between each ink jetting orifice 22 and a corresponding heater element 11 is suitable for the stable jetting of ink droplets.

Figure 27:
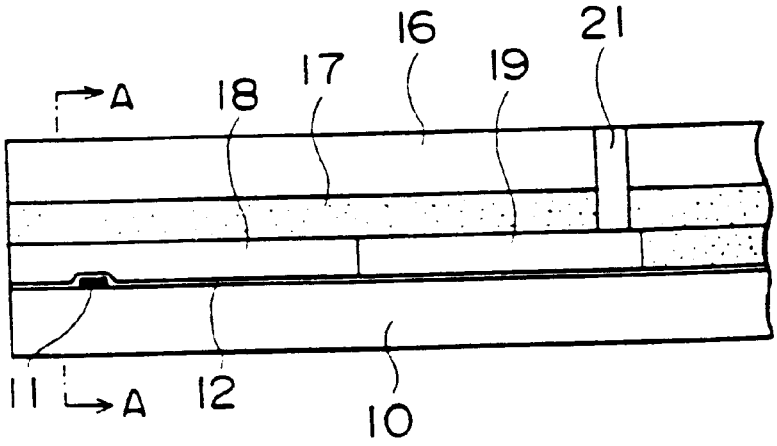
FIG. 27 is a cross sectional view taken along line B—B shown in FIG. 26.
Figure 28:
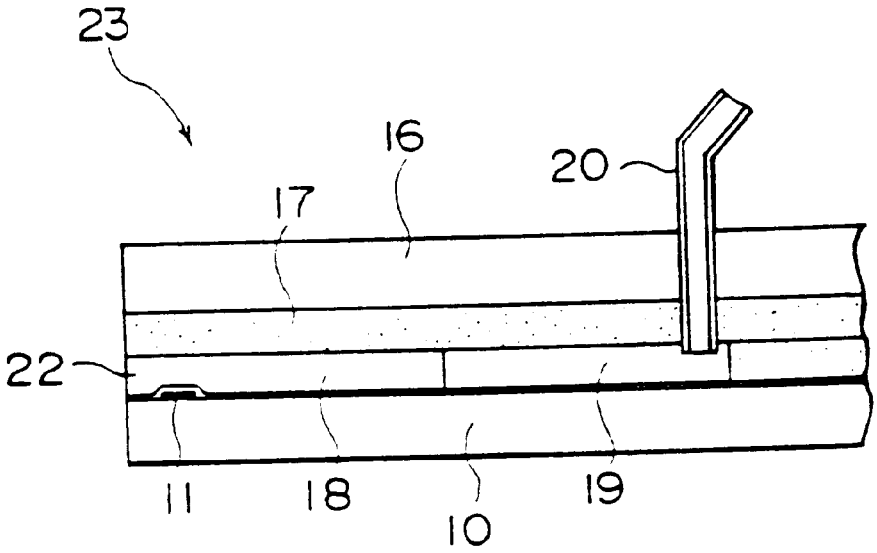
FIG. 28 is a vertical sectional view showing the finished ink jet recording head.

FIG. 27 is a cross sectional view taken along line B—B shown in FIG. 26, and FIG. 28 is a cross sectional view of the completed ink jet recording head.

Due to controlling the thickness of the photoresist layer 13, ink jet recording heads in which the ink jetting orifices 22 and the ink paths 18 are arranged in a density within a range of minimum 24/mm to maximum 48/mm were obtained.

The size of each of the ink jetting orifices 22 is 22 $\mu$m×22 $\mu$m in a case where the ink jetting orifices are arranged in a density of 24/mm, 17 um×17 um in a case where the ink jetting orifices are arranged in a density of 32/mm, and 14 um×14 um in a case where the ink jetting orifices 22 are arranged in density of 48/mm.

Figure 1A:
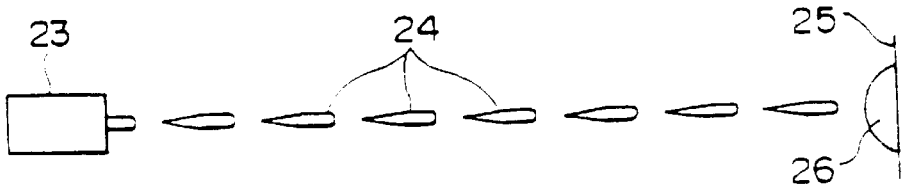
FIG. 1A is a block diagram illustrating a state in which ink droplets are jetted in a first embodiment of the present invention.
Figure 2A:
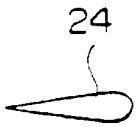
FIG. 2 in parts of (*a*), (*b*), (*c*) and (*d*) is a diagram illustrating detailed shapes of ink droplets being jetted.
Figure 2B:
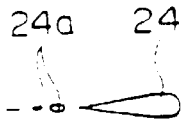
Figure 2C:
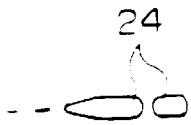
Figure 2D:
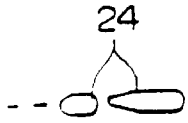

FIG. 1A shows ink droplets 24 successively jetted from the ink jet recording head 23 formed as described above. The ink droplets 24 jetted from the ink jet recording head 23 fly toward a recording medium 25 (e.g. a recording paper) and adhere to the recording medium 25 so that a single dot 26 is formed on the recording medium 25. In this case, it is important that the ink droplets 24 are separately jetted in accordance with pulses supplied to the heater element 11, the ink droplets 24 separately jetted adhere to the recording medium 25. In the conventional case disclosed, for example, in Japanese Laid Open Patent Application No.59-207265, ink droplets jetted from the recording head fly under a condition in which they are connected to each other. It is also important that each of the ink droplets 24 is formed like a slender pillar and flies. In the conventional case disclosed, for example, in Japanese Laid Open Patent Application No.63-53052, each of the ink droplets is formed as a globule. The length of each of the slender pillar shaped ink droplets 24 is n times as large as the diameter thereof ($3 \leqq n \leqq 10$).

To form each of the ink droplets 24 like the slender pillar, each of the ink droplets 24 must be jetted and fly at a high velocity and must be hardly affected by external disturbance (e.g. air flows). Thus, relationships between the shape of each of the ink droplets 24 and the flying velocity thereof and relationships between the shape of each of the ink droplets 24 and a range within which a position at which each of ink droplets 24 is actually located on the recording medium 25 differs from a position at which the single dot 26 is to be formed on the recording medium 25 were experimentally examined, and the results indicated in FIG. 1B. were obtained. The above range is referred to as a positioning variation.

In the above experiment, the jet recording head having the following specifications was used.

SIZE OF INK JETTING ORIFICE 22: 17 $\mu$m×17 $\mu$m
SIZE OF HEATER ELEMENT 11: 14 $\mu$m×84 $\mu$m
RESISTANCE OF HEATER ELEMENT 11: 75 ohm The vehicle having the following composition was used instead of the ink. The vehicle is transparent liquid obtained by removing a dye component from the ink.

Glycerin: 18.0%
Ethyl Alcohol: 4.8%
Water: 77.2%

The accuracy of dotted position was measured using the ink having the following composition.

Glycerin: 18.0%
Ethyl Alcohol: 4.8%
Water: 75.0%
C.I. Direct Black 154: 2.2%

PPC paper 6200 (manufactured by Ricoh Co. LTD) was used as the recording medium 25, and the pulse signal having a frequency of 20 kHz was supplied to the heater element 11.

Referring to the table shown in FIG. 1B, a flying velocity of an ink droplet having a ratio ($I_L/I_D$) equal to or less than 2.8 is small (the flying velocity does not reach 5.0 m/sec.), where $I_L$ is the length of the ink droplet and $I_D$ is the diameter of the ink droplet. In this case, the positioning variation of the ink droplet is large. That is, the ink droplet can not be precisely located at a position at which a single dot is to be formed. If the positioning variation of the ink droplet is equal to or greater than 1 dot, the quality of image deteriorates. From the above results, it is preferable that ink droplets be jetted and fly under a condition where the ratio ($I_L/I_D$) is equal to or greater than 3. In this case, the flying velocity of the ink droplets is 5–10 m/sec. or more, and the ink droplets are hardly affected by the external disturbance. As a result, the ink droplets can go precisely straight and can be incident on a desired position on the recording medium 25 with high accuracy and precision.

The detailed shape of the ink droplet 24 is shown in FIG. 2. An ideal shape of the ink droplet 24 is shown in FIG. 2 (*a*). The ink droplet 24 may fly along with infinitesimal droplets referred to as satellites 24*a* as shown in FIG. 2 (*b*), and may fly under a condition in which the ink droplet 24 is divided into two parts (or three parts) as shown in FIGS. (c) and (d). The shape of the ink droplet 24 as described above depends on the size of the ink jetting orifice 22, the properties (e.g. the viscosity and the surface tension) of the ink, the wave form of pulses supplied to the heater element 11 and the like. In the present invention, the ink droplet divided into a plurality of parts, which are originally to be one droplet, as shown in FIGS. 2 (*c*) and (*d*) is also treated as one ink droplet. In a case where the ink droplet 24 flies along with the satellites 24*a* as shown in FIG. 2 (*b*), if the ink droplet 24 divided into a plurality of parts or the ink droplet 24 and the satellites 24*a* fly at the velocity in a range of 5–10 m/sec or more, the ink droplet 24 divided into a plurality of parts or the ink droplet 24 and the satellites 24*a* can be almost incident to the desired position on the recording medium 25. Thus, the dot can be formed as nearly a true circular dot, and the quality of the image does not deteriorate.

Figures 3A, 3B, 3C, 3D:
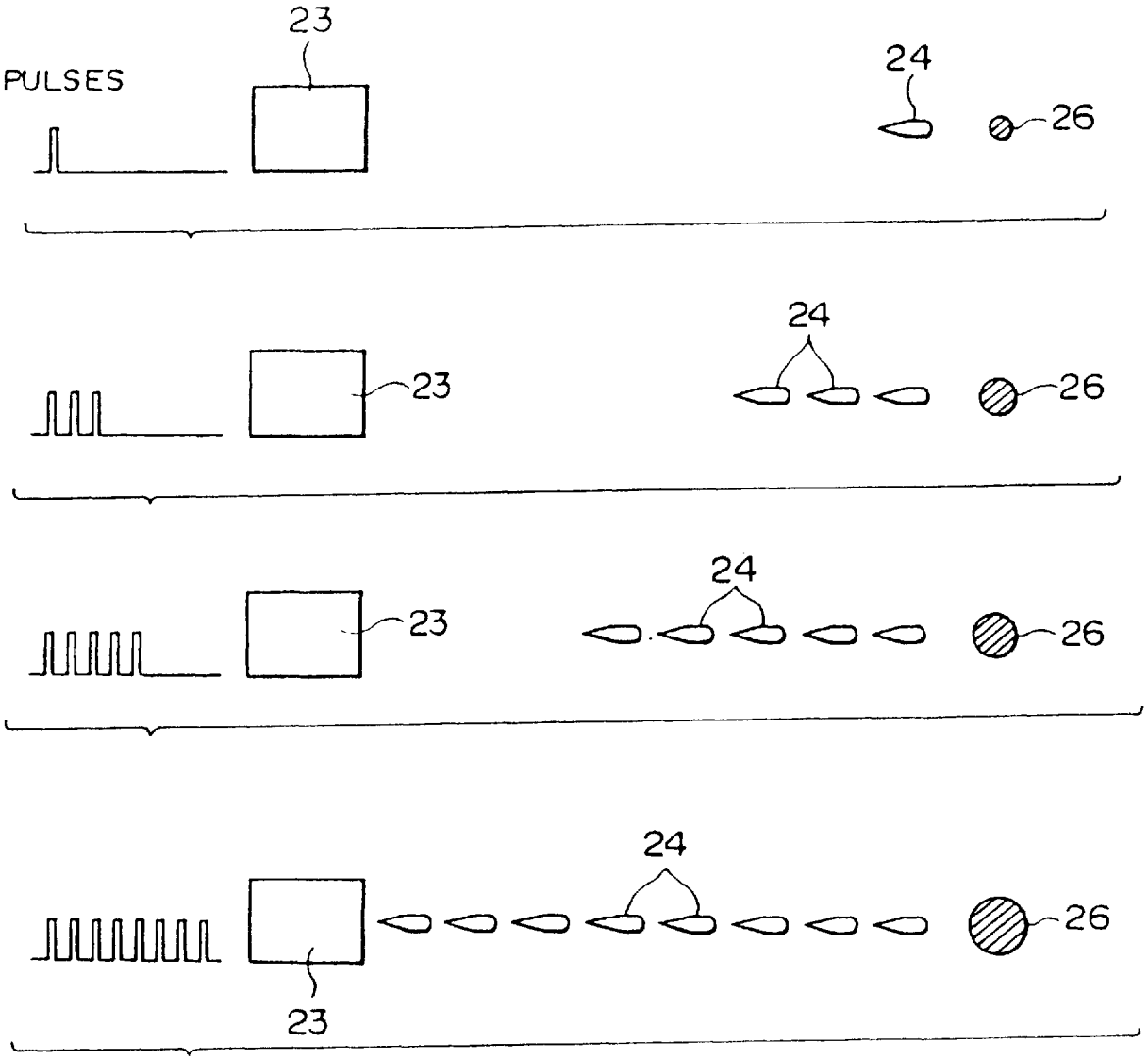
FIG. 3 in parts of (*a*), (*b*), (*c*) and (*d*) is a diagram illustrating relationships among the number of pulses supplied to a heater element, the number of ink droplets jetted from a recording head and sizes of a dot formed on a recording medium.

FIG. 3 shows a state where the number of ink droplets forming a single dot 26 is controlled in accordance with the number of pulses successively input to the heater element 11 so that the size of the single dot 26 is controlled. In FIG. 3 (*a*), one pulse is supplied to the heater element 11 so that one ink droplet 24 is jetted from the ink jetting orifice. The single dot 26 is then formed of one ink droplet 24 incident to the recording medium. In FIG. 3 (*b*), three pulses are supplied to the heater element 11 so that three ink droplets 24 are jetted from the ink jetting orifice. The single dot 26 is then formed of three ink droplets 24 incident to the recording medium. In FIG. 3 (*c*), five pulses are supplied to the heater element 11 so that five ink droplets 24 are jetted from the ink jetting orifice and the single dot 26 is formed of five ink droplets 24. In FIG. 3 (*d*), eight pulses are supplied to the heater element 11 so that eight ink droplets 24 are jetted from the ink jetting orifice and the single dot 26 is formed of eight ink droplets. The larger the number of ink droplets 24 incident to the recording medium, the larger the size of the dot 26 formed of the ink droplets 24.

If the number of pulses successively supplied to the heater element 11 is increased to form a large dot 26, a time for which one dot is formed is also increased. If ink droplets 24 fly under a condition in which they are connected to each other as disclosed in Japanese Laid Open Patent Application No.59-207265, the flying locus of each ink droplet is bad and the reliability of printing deteriorates. Thus, to improve the recording speed, the ink droplets 24 must be jetted at a high frequency under a condition in which the jetted ink droplets are not connected.

A frequency at which the ink droplets were formed was experimentally examined using the ink jet recording head 23 having the following specifications.

SIZE OF INK JETTING ORIFICE: 17 μm×17 μm

SIZE OF HEATER ELEMENT: 14 μm×84 μm

RESISTANCE OF HEATER ELEMENT: 75 ohm

ARRANGEMENT DENSITY OF INK JETTING ORIFICES: 32/mm (=800 dpi)

NUMBER OF INK JETTING ORIFICES: 256

Using the ink jet recording head having the above specifications and the vehicle having the surface tension of 49.3 dyn/cm and the viscosity of 1.39 cp, a pulse signal having a voltage of 6V (a driving voltage), a pulse width (Pw) of 4 μsec. and the frequency of 20 kHz was supplied to the heater element 11. In this case, droplets were successively jetted with good conditions at a velocity of 11.7 m/sec (which was measured at a position far from the ink jetting orifice 22 by 0.5 mm).

Figure 4A:
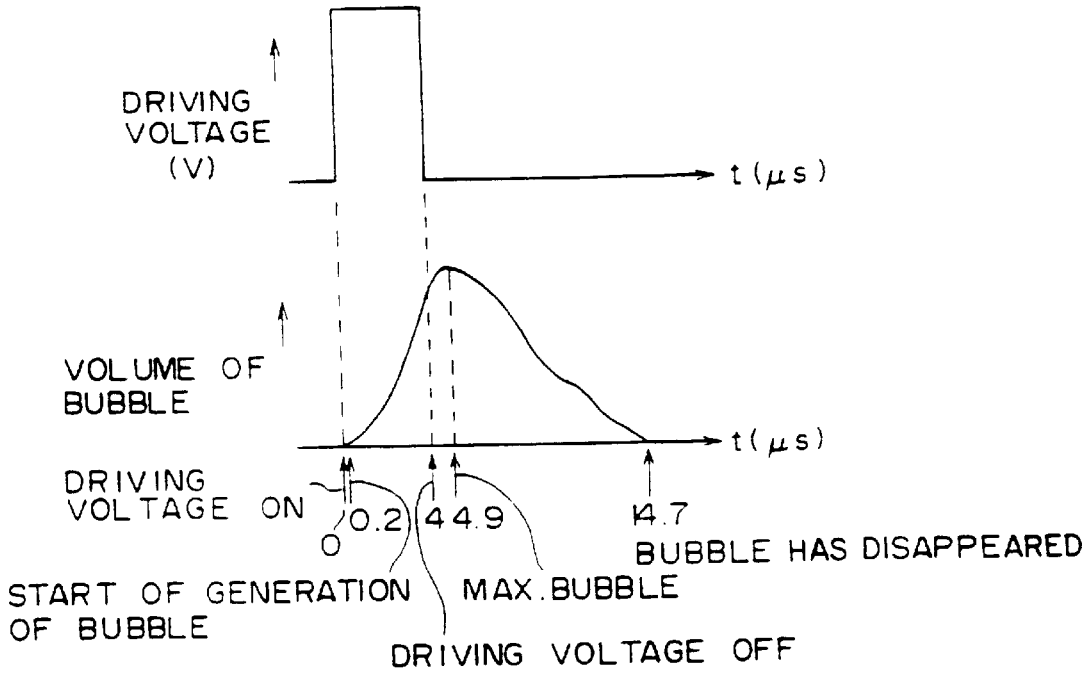
FIG. 4A is a wave form chart illustrating an input pulse and a variation curve of a bubble.

In the above experiment, the state of bubbles were observed through the transparent plate 16 (shown in FIGS. 24–28). The result as shown in FIG. 4A was obtained. FIG. 4A shows the wave form of a pulse and the profile of a bubble in the same time scale. Referring to FIG. 4A, when the driving voltage was turned on and a pulse was input to the heater element 11, the growth of the bubble started slightly delayed (0.2 μsec.) from the start of growth of the bubble. While the bubble was gradually being expanded, the driving voltage was turned off. The bubble was continuously being expanded for a time (4 μsec.) after the driving voltage was turned off. After 4.9 μsec. from the turning on of the driving voltage, the bubble reached the maximum size. After this, the bubble was contracted, and was completely disappeared after 14.7 μsec. from the turning on of the driving voltage.

Next, the profile of the bubble was examined with the frequencies of the pulses; 10 kHz, 30 kHz and 40 kHz. In cases of the respective frequencies (10 kHz, 30 kHz and 40 kHz), a time required for the expansion of the bubble to the maximum size (4.8–5.1 μsec.) and a time interval separating the turning on of the pulse signal from the disappearance of the bubble (14.7–15 μsec.) were hardly changed. That is, it was confirmed that the profile of the bubble did not depend on the frequency of the pulses.

Further, increasing the frequency of the pulses, the maximum frequency of the pulses with which the ink droplets 24 could be stably jetted was examined. As a result, the ink droplets were stably jetted until the frequency of the pulses exceeds 51 kHz. In a case of the frequency of 51 kHz, the flying velocity of the ink droplets 24 was 12.5 m/sec. Further, in a case where the frequency of the pulses was 55 kHz, the ink droplets 24 were being jetted for a few seconds (2–3 seconds), and the jetting of the ink droplets was then stopped.

To know the reason why the ink droplets were not stably jetted with the frequency of the pulses exceeding 51 kHz, the profile of the bubble was carefully examined with a frequency of the pulses within a range of 50–55 kHz. In a case where the frequency of the pulses did not exceed 51 kHz, the bubble was expanded, contracted and disappeared in accordance with the profile as shown in FIG. 4A. On the other hand, in a case where the frequency of the pulses was 52 kHz, the bubble varied in accordance with the profile as shown in FIG. 4A for first a few seconds, but after this, the bubble did not disappear and covered the heater element 11. As a result, generation, expansion, contraction and disappearance of the bubble were not carried out in the ink, so that the jetting of the ink droplets was stopped.

According to the above experiment, the maximum frequency of the pulses with which the ink droplets can be stably jetted is 51 kHz.

Figure 4B:
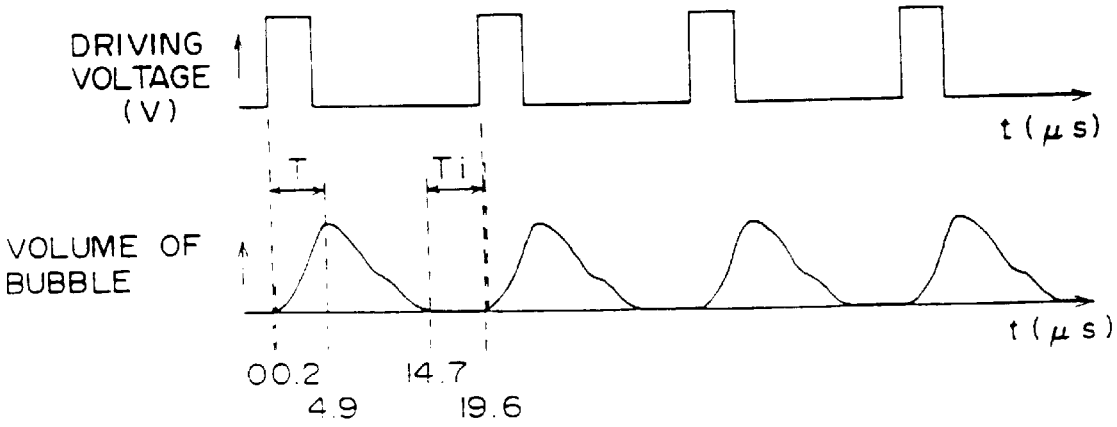
FIG. 4B is a wave form chart illustrating pulses sequentially input and variation curves of bubbles.

Here, FIG. 4B shows the wave form of pulse having the frequency of 51 kHz and the profile of bubbles in the same time scale. Referring to FIG. 4B, "T" indicates a time interval separating the occurrence of the maximum bubble from the input of the pulse signal (in this case, T=4.9 μsec.). From FIG. 4B, it is known that, on and after 4T (=19.6 μsec.) from the input of a prior pulse, the next pulse may be input to the heater element 11 in order to stably get ink droplets. In a case of the pulses of 51 kHz, the period of each cycle is 1/(51×1000) seconds, that is, 19.6 μsec.

In the other words, if a time interval "Ti" separating the start of growth of the bubble from the disappearance of the prior bubble is greater than the above time interval "T", the ink droplets can be stably jetted with the maximum frequency.

The above result is obtained based on the profile of the bubbles jetted from the ink jet recording head having the following specifications.

SIZE OF INK JETTING ORIFICE: 17 μm×17 μm

ARRANGEMENT DENSITY OF INK JETTING ORIFICES: 32/mm (=800 dpi)

Profiles of bubbles jetted from ink jet recording heads having other specifications are shown in FIG. 5. In FIG. 5, each time interval starts from the input of the pulse signal, and the pulse signal has the frequency of 5 kHz.

Increasing the frequency of pulses from 5 kHz, the critical condition under which the ink droplets could be stably jetted was experimentally examined. As a result, in a case where the ink jetting orifices 22 were arranged in a density of 48/mm, the critical condition was a condition that the frequency of the pulses was about 75 kHz. In this case, the flying velocity of the ink droplets 24 was 11.1 m/sec. In addition, in a case where the ink jetting orifices 22 were arranged in a density of 24/mm, the critical condition was a condition that the frequency of the pulses was about 46 kHz. In this case, the flying velocity of the ink droplets 24 was 10.7 m/sec. In these case, if the frequency of the pulses were increased, the bubble covered the heater elements 11 so that the jetting of the ink droplets was stopped.

On the other hand, in a case where the ink jetting orifices 22 were arranged in a density of 16/mm, the jetting of the ink droplets was stopped with a frequency of the pulses within a range of 9–9.5 kHz. In addition, in a case where the ink jetting orifices 22 were arranged in a density of 8/mm, the jetting of the ink droplets was stopped with a frequency of the pulses within a range of 6–7 kHz. In these case, the heater elements 11 were broken.

The above results are caused by the following matters.

In general, when a bubble is contracted and disappeared in the ink, an impulse force is generated by the cavitation action. The larger the bubble, the stronger the action of this impulse, generated by disappearance of the bubble, with respect to the heater element. In the above experiment, it is believed that the breakage of the heater elements of the ink jet recording heads having the ink jetting orifices 22 arranged in densities 8/mm and 16/mm is caused by the impulse force generated in the ink. That is, in a case where the frequency-of the pulses supplied to the heater element is 5 kHz, there is no problem, but, due to increasing of the frequency of the pulses, the number of times that the impulse force acts to the heater element is gradually increased, so that the heater element is not resisted and is broken.

On the other hand, in the cases where the ink jet recording heads having the ink jetting orifices arranged in densities of 24/mm and 48/mm were used, the heater elements of the ink jet recording heads were not broken. It is believed that this result was obtained by the reason that bubbles generated in the ink are small so that the impulse force acting to the heater element is also small.

Under various conditions, the durability of the heater element was experimentally examined. In this examination, ink jet recording heads having ink jetting orifices arranged in densities of 8/mm, 16/mm, 24/mm, 32/mm and 48/mm were used, and the pulse signal supplied to each of the heater elements had the same driving voltage and the same pulse width as that used in the above case shown in FIGS. 4A and 4B. In a case where the heater elements were driven in air, there was no problem under conditions in which the pulse signal having the frequency of 100 kHz was supplied to the heater element and the heater element was being driven for 3 hours (the number of pulses is 109). In a case where the heater element was driven by driving pulses having various frequencies in the vehicle, the result as shown in FIG. 5B were obtained.

Referring to FIG. 5B, in a case where the heater element is large and the bubble generated in the ink is large (e.g. the arrangement density of ink jetting orifices 8/mm and 16/mm), the heater element is broken with a frequency of pulses less than the maximum frequency. On the other hand, in a case where the heater element is small and the bubble generated in the ink is small (e.g. the arrangement density of ink jetting orifices 24/mm, 32/mm and 48 mm), even if the heater element is being driven by pulses having the maximum frequency for a time corresponding to the number of pulses equal to or greater than 109, the heater element is not broken. In this case, it is defined that the heater element has durability greater than 109. The longitudinal length of each of the ink droplets is 380 $\mu$m in a case of 8/mm, 195 $\mu$m in a case of 16/mm, 115 $\mu$m in a case of 24/mm, 90 $\mu$m in a case of 32/mm and 60 $\mu$m in a case of 48/mm.

From the above results, it can be seen that in an ink jet recording head having practically small orifices arranged in a high density, the upper limit condition to jet ink droplets at high frequency is a condition under which a pulse must be input to the heater element after 4T from the time that a prior pulse has been input thereto, where T is a time period from a time that a pulse signal is input to the heater element to a time that the bubble reaches the maximum size. In other words, if the heater element 11 is driven under a condition in which a time period from a time that the bubble is disappeared to a time that the generation of the next bubble starts is greater than the time period "T", the ink droplets can be stably jetted at the maximum frequency.

In the present-invention, the ink droplets can be jetted with energy smaller than that to be supplied to a convention recording head. Each of the ink jetting orifices through which the ink droplets are jetted is smaller than that (50 $\mu$m×40 $\mu$m) of the conventional recording head disclosed, for example, in Japanese Patent Publication No.59-43312. In a case where the ink jetting orifices are small, it is difficult to stably jet the ink droplets through the ink jetting orifices, because fluid resistance is increased.

Thus, the inventors experimentally examined the amount of energy to a unit area of the ink jetting orifice required for the jetting of the ink droplets. In the examination, three (1), (2) and (3) ink jet recording heads having the following specifications were used.

| ARRANGEMENT DENSITY OF INK JETTING ORIFICES |
|---|
| (1) 24/mm |
| (2) 32/mm |
| (3) 48/mm |
| SIZE OF INK JETTING ORIFICE |
| (1) 22 $\mu$m × 22 $\mu$m |
| (2) 17 $\mu$m × 17 $\mu$m |
| (3) 14 $\mu$m × 14 $\mu$m |

Other conditions are the same as those in the above experiments.

Varying the driving voltage corresponding to the energy supplied to the heater element, the flying velocity Vi (m/sec.) of each of the ink droplets jetted through the ink jetting orifices was measured. In each type of the ink jet recording head, the frequency of pulses supplied to the heater element is 10% less than the maximum frequency. That is, in the respective cases of the ink jet recording head having the ink jetting orifices arranged in densities of 24/m, 32/mm and 48/mm, the frequencies of the pulses were 40 kHz, 45 kHz and 65 kHz. The pulses supplied to the respective ink jet recording heads having the ink jetting orifices arranged in densities of 24/mm, 32/mm and 48/mm had the pulse widths of 4.5 $\mu$sec., 4 $\mu$sec. and 3 $\mu$sec. The results of the above examination are shown in FIG. 5C.

Referring to FIG. 5C, when a ratio E/S (J/cm$^2$) of the energy (E) required for the jetting of the ink droplets to the area (S) of the ink jetting orifice is less than about 0.3, each of the ink droplets has a circular shape, the flying velocity is small and the flying state of the ink droplets are unstable. On the other hand, when the ratio (E/S) is greater than 3, the heater element is broken.

From other point of view, in a case where ink droples are jetted from very small orifices (14 $\mu$m×14 $\mu$m–22 $\mu$m×22 $\mu$m) at a very high frequency (more than 10 kHz), it is prefarable that the heater element is driven under the following condition. In the ink jet recording head having the ink jetting orifices arranged in a density of 24/mm, it is preferable that the energy falling within a range of 1.46 $\mu$J (corresponding to the driving voltage of 5 v) –15.0 $\mu$J (corresponding to the driving voltage of 16 v). In the ink jet recording head having the ink jetting orifices arranged in a density of 32/mm, it is preferable that the energy falling within a range of 0.90 $\mu$J (corresponding to the driving voltage of 4.1 v)–8.74 $\mu$J (corresponding to the driving voltage of 12.8 v). In the ink jet recording head having the ink jetting orifices arranged in a density of 48/mm, it is preferable that the energy falling within a range of 0.62 μJ (corresponding to the driving voltage of 3.8 v)–5.97 μJ (corresponding to the driving voltage of 11.8 v).

In the present invention, the size of each dot formed on the recording medium (e.g. a paper) is controlled based on the number of ink droplets jetted at a very high frequency (10–75 kHz) and adhered to a single position on the recording medium. Thus, the relationships between the number of ink droplets jetted and adhered to a single position and the size of a dot formed at the single position were experimentally examined. The ink jet recording head used in this examination had the following specifications.

SIZE OF INK JETTING ORIFICE: 17 μm×17 μm

ARRANGEMENT DENSITY OF INK JETTING ORIFICES: 32/mm

Other specifications of the ink jet recording head were the same as those in the the above experiments. The ink used in this examination had the following composition.

Glycerin: 18.0%

Ethyl Alcohol: 4.8%

Water: 75.0%

C.I. Direct Black 154: 2.2%

The heater element was driven under the following conditions.

DRIVING VOLTAGE: 6V

PULSE WIDTH OF DRIVING PULSE: 4 μsec.

FREQUENCY OF DRIVING PULSE: 45 kHz

The number of pulses supplied to the heater element to form a single dot was increased from 1 to 50 one by one, the diameter of a dot formed on the recording medium in accordance with the number of pulses supplied to the heater element was measured. PPC papers 6200 (manufactured by RICOH CO. LTD.) and mat coated sheets NM (manufactured by MITSUBISHI SEISHI CO. LTD.) were used as the recording medium.

Figure 6:
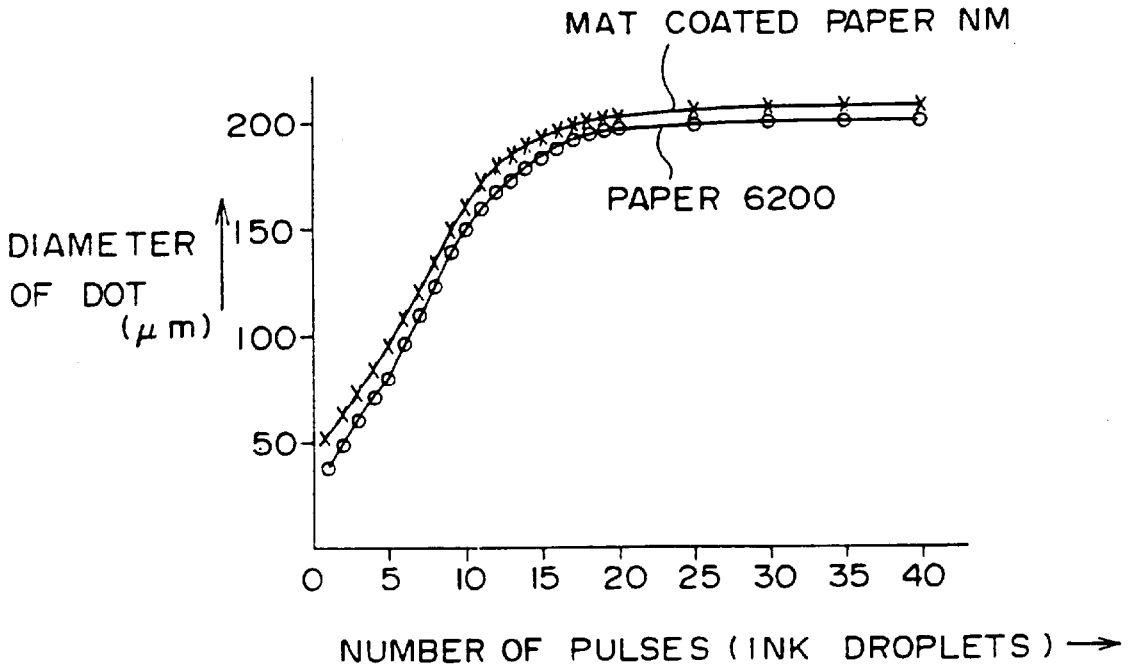
FIG. 6 is a graph illustrating a relationship between the number of ink droplets forming a single dot and the diameter of the dot.

The results of this examination are shown in FIG. 6. In a graph shown in FIG. 6, the axis of abscissa indicates the number of ink droplets for a single dot, and the axis of ordinate indicates the diameter of the single dot formed on the recording medium.

Until the number of the ink droplets reaches a predetermined value, when the number of the ink droplets for a single dot is increased, the diameter of the single dot formed on the recording medium becomes large. On the other hand, under a condition in which the number of the ink droplets has reached the predetermined value, the diameter of the dot does not depend on the number of the ink droplets. Since a single dot is formed of a plurality of ink droplets, although the ink droplets are jetted at a frequency of 45 kHz, a frequency at which dots are formed on the recording medium is less than 45 kHz. This frequency is referred to as a dot forming frequency. If the maximum dot is formed on n ink droplets jetted at a frequency of 45 kHz, dots are formed on the recording medium at a dot forming frequency of 45/n kHz. A dot forming frequency at which dots each made of one ink droplet are formed is equal to that at which dots each made of n ink droplets are formed of. The relationships between a frequency at which the ink droplets are jetted and the dot forming frequency are shown in FIG. 7A.

Figures 7A, 7B:
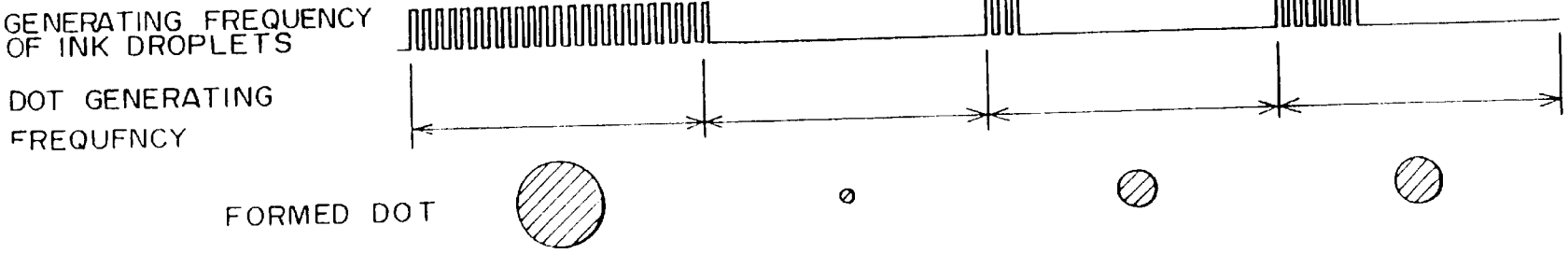
FIG. 7A is a diagram illustrating the intervals at which an ink drop is generated, the intervals at which a dot is formed, and the dot size.
FIG. 7B is a table indicating the size of a single dot formed on various types of recording mediums.

In an example shown in FIG. 7A, the number of ink droplets for a single dot is changed within a range of 1–22, and the size of the single dot is controlled by the number of ink droplets. When the frequency of the pulses supplied to the heater element is 22 kHz, the dot forming frequency is 1 kHz. Since a time period for one page is printed depends on the dot forming frequency, it is preferable that the dot forming frequency be large as possible. That is, as a printing speed is decreased, it is not preferable that the number of ink droplets for a single dot be increased too many. Referring to the results shown in FIG. 6 in the light of this, in a case where the number of ink droplets for a dot is less than 20, the diameter of the dot is relatively strongly changed in accordance with the change of the number of ink droplets. In a case where the number of ink droplets for a dot falls within a range 20–30, the diameter of the dot is relatively slightly changed in accordance with the change of the number of ink droplets. Further, in a case where the number of ink droplets is equal to or greater than 30, even if the number of ink droplets for a dot is increased, the diameter of the dot is almost not changed.

It is desirable that the number of ink droplets for a dot be controlled within a range less than 30. Furthermore, the number of ink droplets for one dot is preferably controlled within a range less than 20, and further preferably controlled within a range less than 10.

According to the present invention, the ink droplets can be jetted at a frequency greater than 10 kHz (it is impossible for the conventional recording head having the orifices arranged at a density 16/mm to do so). The maximum frequency at which the ink droplets can be jetted is 75 kHz. In this case, the dot forming frequency falls within a range 0.3–7.5 kHz.

A description will now be given of results of recording experimentally performed.

In this experimental recording, four ink jet recording head to respective which yellow ink, magenta ink, cyan ink and black ink are set are used. Each of the ink jet recording head has 256 ink jet orifices arranged in a density of 32/mm. Dots are formed on a A4 sized paper (mat coated sheet NM manufactured by MITSUBISHI SEISHI CO., LTD.). The printing is performed under the following conditions.

FREQUENCY OF PULSES: 45 kHz

NUMBER OF INK DROPLETS FOR A SINGLE DOT: 1–15

DOT FORMING FREQUENCY: 3 kHz

Each pixel of a image is formed of 4×4 dot matrix each dot being formed on one or a plurality ink droplets, so that each pixel may have 256 half-tone levels. Pixels in the image are arranged in a density 8/mm.

Under the above conditions, the ink jet recording heads scanned the A4 sized paper in 34 times for about 2 minutes. As a result, an image having a high quality is formed on the A4 sized paper.

In the present invention, the maximum number of ink droplets to be incident to a position on the recording medium 25 is changed. That is, the ink jet recording mode can be operated in two mode, a normal mode and a draft mode. In the normal mode, the number of ink droplets 24 for a single dot is controlled, for example, within a range of 1–10. In the draft mode, the number of ink droplets for a single dot is controlled, for example, within a range of 1–5. In this case, the printing speed in the draft mode is twice as large as that in the normal mode. In the draft mode, a rough image can be rapidly obtained.

The ink jet recording head prints images in accordance with non-impact and non-contact recording method. Thus, images can be formed on various recording medium (e.g. a copying paper, a reproduced paper, an OHP sheet, a post card). However, the size of each dot formed of the recording medium 25 is changed in accordance with a kind of recording medium. FIG. 7B shows relationships between a kind of recording medium and the size of the dot formed on the recording medium. In FIG. 7B, there are provided three kinds (A), (B) and (C) of recording medium, and FIG. 7B indicates the mass of ink and the size of each dot formed on each of kinds of the recording mediums (A), (B) and (C). On each of the recording medium, a dot made of a single ink droplet, a dot made of five ink droplets and a dot made of ten ink droplets were formed. $6\times10^5$ ink droplets are gathered (ink droplets jetted at a frequency 20 kHz are gathered for 30 seconds), and the mass of ink of each dot is calculated based on the weight of gathered ink. The size of each dot is measured using an optical microscope with an x-y stage. The mass of ink of each dot indicated in FIG. 7B is obtained by an average of 30 measured values.

Referring to FIG. 7B, a dot formed on the recording medium (B) is slightly larger than that formed on the recording medium (A), and a dot formed on the recording medium (C) is significantly larger than those formed on the recording mediums (A) and (B). That is, as shown by these results, the degree of expansion of an ink dot on a recording medium depends on the kind of recording medium. In this case, it can readily be seen by reference to FIG. 7B, for example, that medium (C) has a higher degree of expansion than medium (B) and medium (B) has a higher degree of expansion than medium (A). Images were experimentally formed on the respective recording mediums (A), (B) and (c) under the same conditions and observed. In this case, the image formed on the recording medium (B) was slightly darker than that formed on the recording medium (A), but, the image formed on the recording medium (C) was significantly darker than those formed on the recording mediums (A) and (B). On each of the recording mediums (A), (B) and (C), a dot having the maximum size was formed of 10 ink droplets 24. From these results, it will be appreciated that the number of ink droplets necessary for forming a dot of a predetermined size can be smaller for a recording medium in which the degree of expansion is higher.

Next, under a condition in which the number of ink droplets 24 for a dot having the maximum size is eleven, a dot image was formed on the recording medium (A). In this case, the dot image having almost the same density as that formed on the recording medium (B) under the condition (the maximum sized dot is formed of ten ink droplets) described above was obtained. Furthermore, under a condition in which the number of ink droplets 24 for a dot having the maximum size is fourteen, a dot image was formed on the recording medium (A). In this case, the dot image having almost the same density as that formed on the recording medium (C) under the condition (the maximum sized dot is formed of ten ink droplets) described above was obtained.

From the above result, even if a kind of recording medium is changed, due to changing the number of ink droplets for a single dot having the maximum size, images having almost the same quality can be formed on the various kinds of recording mediums. In this case, of course, the number of ink droplets for a single dot having another size is also changed. That is, due to controlling of the maximum number of ink droplets to form each dot in an image, the density of the image can be controlled.

This control method for controlling the density of the image can be also applied to an ink jet recording head in which ink droplets are jetted using piezo-electric elements or continuous ink jet recording head.

Figure 8:
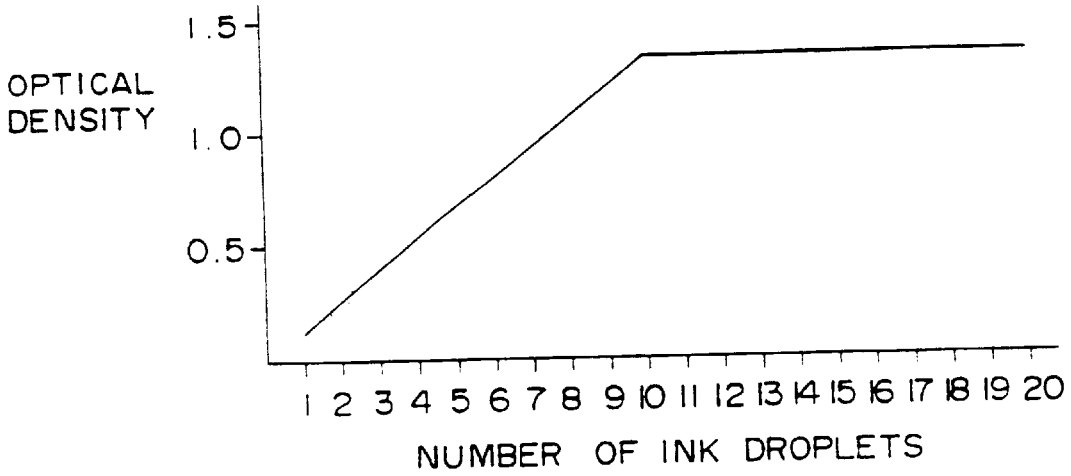
FIG. 8 is a graph illustrating an ideal relationships between the number of ink droplets adhered at the same point on the recording medium and image density of the printed area.
Figure 9:
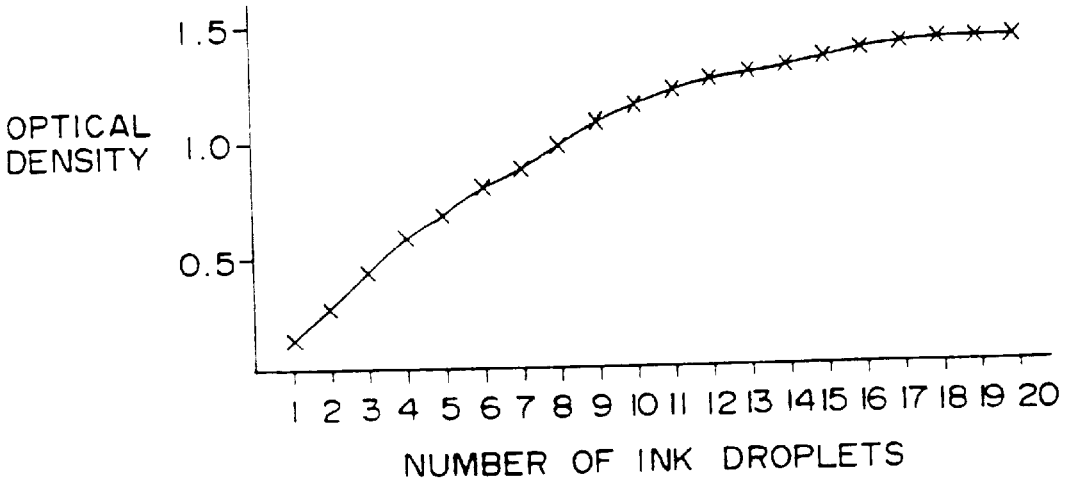
FIG. 9 is graph illustrating a measuring result of relationships between the number of ink droplets adhered at the same point on the record medium and the image density of the printed area measured optically.

It is preferable that a relationship between the number of ink droplets for a dot and the density of the printed area be linear, as shown in FIG. 8, in a range starting from the minimum density to the maximum density. However, the actual relationship between the number of ink droplets for a dot and the density of the printed area is not linear as shown in FIG. 9. The relationship shown in FIG. 9 was experimentally obtained the following printing conditions.

SIZE OF INK JETTING ORIFICE: 17 $\mu$m×17 $\mu$m

SIZE OF HEATER ELEMENT: 14 $\mu$m×84 $\mu$m

RESISTANCE OF HEATER ELEMENT: 77 ohm

ARRANGEMENT DENSITY OF INK JETTING ORIFICES: 800 dpi

The ink used in this examination had the following composition.

Glycerin: 18.0%

Ethyl Alcohol: 4.8%

Water: 75.0%

C.I. Direct Black 154: 2.2%

PPC papers 6200 (manufactured by RICOH CO., LTD) were used as the recording medium 25. An area of 10 mm×10 mm was filled with all black dots each dot formed of ink droplets. The number of the ink droplets was selected from among 1, 2, 3, and 20. The density of the area filled with all black dots was measured, and the results as shown in FIG. 9 was obtained.

Referring to FIG. 9, in a low density range, the density is almost linearly increased in accordance with the increasing of the number of ink droplets, but in a high density range close to the saturated density, the density is loosely increased in accordance with the increasing of the number of ink droplets and a desired density is not obtained if the number of the ink droplets is not greatly increased.

Figure 10:
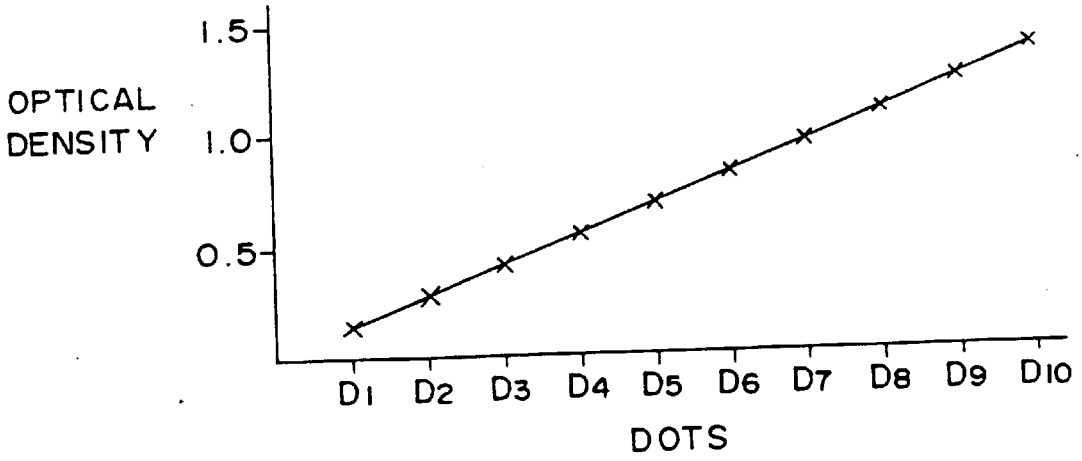
FIG. 10 is a graph illustrating relationships between dots and the image density thereof.

The number of ink droplets of which each dot is to be formed is determined such that the relationship between the density of the area and dots filling the area is linear as shown in FIG. 10. The dots D1, D2, D3, D4, D5, D6, D7, D8, D9 and D10 are respectively formed, for example, of 1, 2, 3, 4, 5, 6, 8, 10, 12 and 20 ink droplets. That is, the relationship between the kind of dot and the number of the ink droplets forming the dot is not linear. If the size of dot in an image is controlled in accordance with the relationship shown in FIG. 10, the desired density can be easily obtained and the image having a high quality can be formed on the recording medium.

In the present invention, the center of each dot formed of one or a plurality of ink droplets is positioned approximately at the center of an area on which the dot is to be formed. The distance between dots adjacent to each other is approximately constant, and the distance between centers of sets of pulses to be supplied to the heater element to form dots adjacent to each other is approximately constant.

Figure 11:
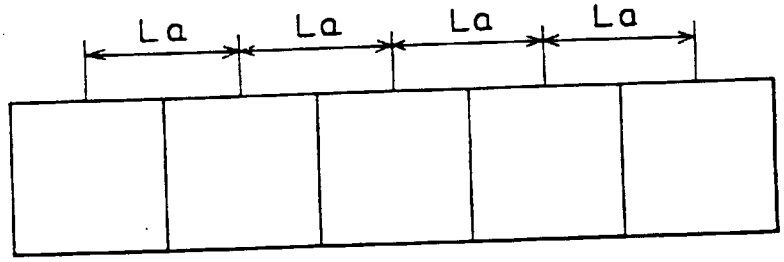
FIG. 11 is a diagram illustrating five areas of the recording medium on each of which a single dot is to be formed.
Figure 12:
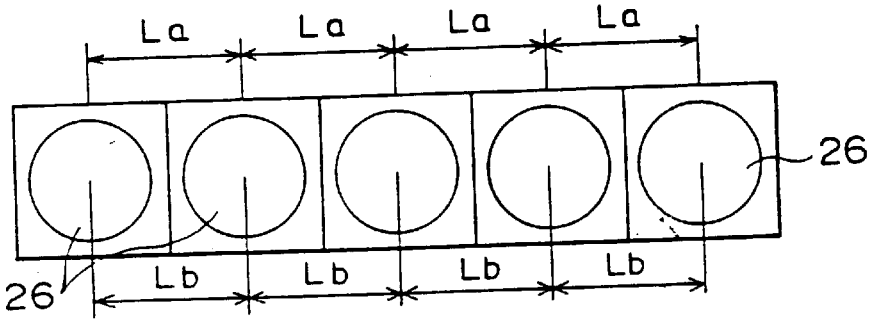
FIG. 12 is a diagram illustrating the respective areas of the recording medium on each of which a binary recording dot has been formed.

FIG. 11 shows five square areas on the recording medium 25 on each of which areas a dot is to be formed. FIG. 12 shows binary dots 26 formed on the five square areas shown in FIG. 11. In a case where binary dots are formed on the recording medium, the center of each of dots 26 is positioned approximately at the center of each of the square areas, and the distance La between the centers of the adjacent square areas and is approximately equal to the distance Lb between the centers of adjacent dots 26 formed on the square areas.

Figure 13A:
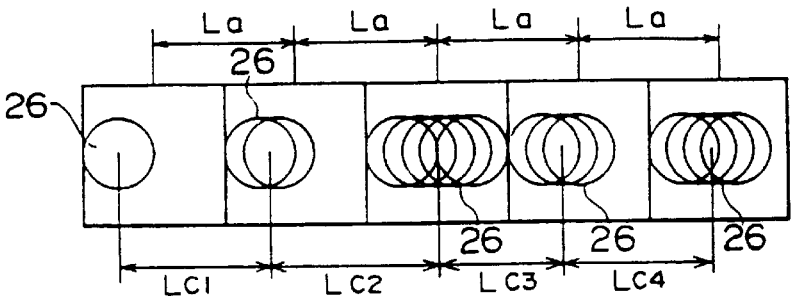
FIG. 13A PRIOR ART
FIG. 13 in parts (*a*) and (*b*) is a diagram illustrating a position at which a dot is formed on an area and the generating timing of pulses in a conventional technique by which a single dot is formed of one or a plurality of ink droplets.
Figure 13B:
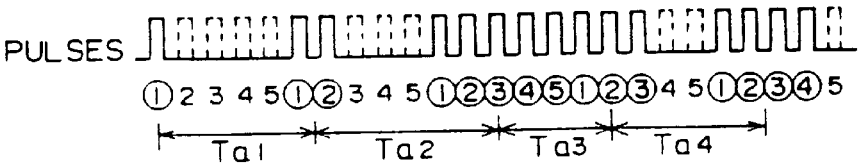
FIG. 13B PRIOR ART

FIG. 13 shows a conventional case in which dots are formed on the five square areas each dot being formed of one or a plurality of ink droplets. In FIG. 13, the center of a dot is not positioned at the center of a square area, and the distances Lc1, Lc2. Lc3, and Lc4, each of which is a distance between the centers of the adjacent dots, differ from each other. Thus, there is a problem in that the quality of the image formed of the dots deteriorates. This problem occurs because the printing operation is performed while the ink jet recording head and the recording medium are being moved relatively and a time period required for the forming of a dot depends on the number of ink droplets forming the dot. The distances Ta1, Ta2, Ta3, and Ta4, each of which is a distance between the centers of adjacent sets of pulses supplied to the heater element, differ from each other. In FIG. 13, the maximum number of ink droplets forming a single dot is five, and the ink droplets are jetted by the pulses shown by continuous lines.

Figure 14A:
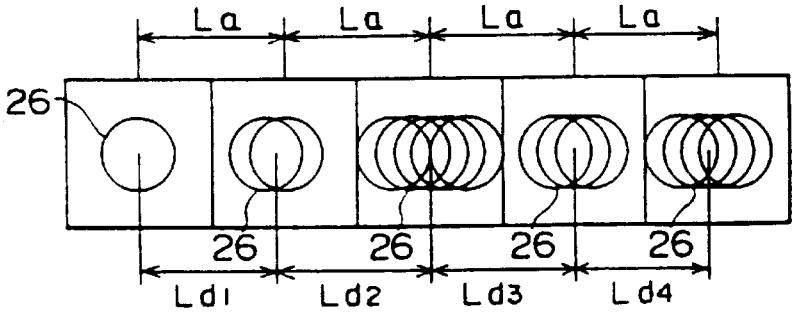
FIG. 14 in parts (*a*) and (*b*) is a diagram illustrating a position at which a dot is formed on an area and the generating timing of pulses in the present invention.
Figure 14B:
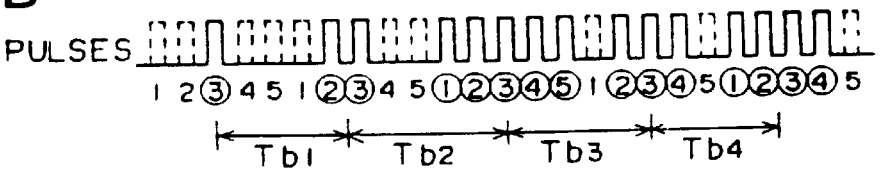

FIG. 14 shows a case of the present invention. In this case, when a small number of ink droplets forms a single dot, supply of the pulse signal to the heater element is delayed. For example, when one ink droplet forms a single dot, a third pulse among five pulses is supplied to the heater element, five pulses being the maximum number of pulses to be supplied to the heater element to form a single dot. When two ink droplets form a single dot, second and third pulses among the five pulses are supplied to the heater element. Due to delaying the supply of the pulse signal to the heater element, the center of each dot can be positioned approximately at the center of an area on which the dot is to be formed, and the distances Ld1, Ld2, Ld3, and Ld4 between adjacent dots can be approximately constant. As a result, the quality of the image can be improved. In the above control of the pulse signal supplied to the heater element, the center of each dot may vary for one pulse in accordance with whether the number of pulses is an even number or an odd number. However, the variation for one pulse can be a negligible quantity. In the light of this, when two ink droplets form a single dot, third and fourth pulses among the five pulses may be supplied to the heater element.

To simplify, FIGS. 13 and 14 shows dots formed on the areas such that there is a space between adjacent dots. However, in actual cases where a line is printed and whole black image printed, dots are continuously formed such that adjacent dots are overlapped. In addition, in FIGS. 13 and 14, a dot 26 formed of a plurality of ink droplets is extremely shown so as to be long sideways. However, in actual fact, each dot 26 is approximately circular.

Distances Tb1, Tb2, Tb3 and Tb4 between the centers of adjacent sets of pulses are approximately constant, each set of pulses being supplied to the heater element to form a single dot. The center of each set of pulses varies for one pulse in accordance with whether the number of pulses is an even number or an odd number in the same manner as the case of each dot described above. However, the variation for one pulse can be a negligible quantity.

Figure 15:
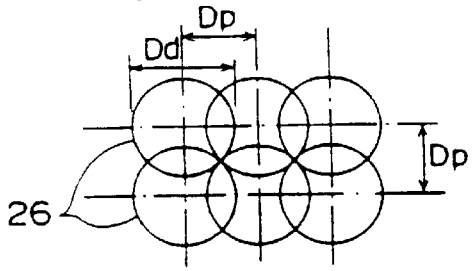
FIG. 15 is dots formed by a normal ink jet recording head for forming binary image.
Figure 16A:
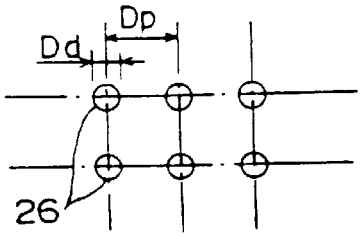
FIG. 16 in parts (*a*), (*b*), (*c*), (*d*), (*e*) and (*f*) is a diagram illustrating relationships between the number of ink droplets forming a single dot and the diameter of the dot and a white ground area among dots.
Figure 16B:
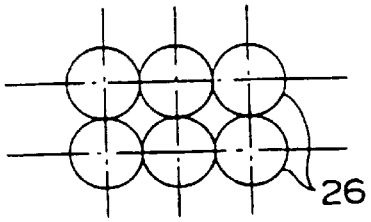
Figure 16C:
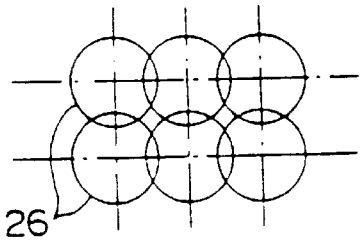
Figure 16D:
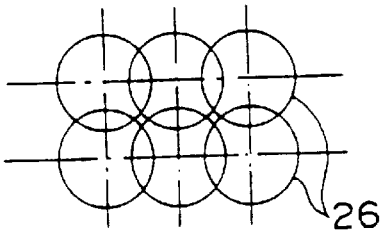
Figure 16E:
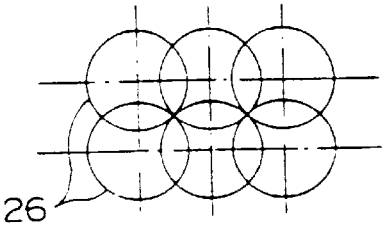
Figure 16F:
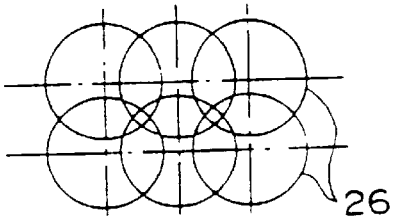

In a normal ink jet recording head for forming a binary image, when a whole black image is formed, adjacent dots in the whole black image are overlapped and there is no white space among dots. There is no white space among dots under a condition of $D_d \geqq \sqrt{2} \cdot D_p$, as shown in FIG. 15, where $D_d$ is a diameter of each dot and $D_p$ is a distance between the centers of adjacent dots. For example, in a case where dots are formed in a density of 400 dpi, the distance $D_p$ between the centers of adjacent dot is equal to 63.5 μm ($D_p$=63.5 μm). In this case, if the diameter $D_d$ of each dot is equal to or greater than 90 μm ($D_d \leqq 90$ μm), there is no space among dots so that a whole black image is formed. To obtain dots each having such diameter, in an edge shooter type of conventional thermal ink jet printer head, each of the ink jetting orifices has the size of approximately 28 μm×28 μm.

An ink jet recording printer according to the present invention controls the size of each dot formed on the recording medium so that a half-tone image is obtained. In this ink jet recording head, the ink jetting orifices are arranged in a density of 400 dpi, each orifices having a size of 16 μm×16 μm. In addition, each heater element has the size of 15 μm×60 μm and the resistance thereof is 61.7 ohm.

Ink droplets were jetted from the above ink jet recording head according to the present invention using the ink having the following composition.

Glycerin: 18.0%

Ethyl Alcohol: 4.8%

Water: 75.0%

C.I. Direct Black 154: 2.2%

As a result, under a condition where the frequency of the pulses supplied to the heater element 11 is equal to less than 53 kHz, the ink droplets were stably jetted from the ink jet recording head.

Ink droplets were jetted from all the ink jetting orifices so that a whole black image was formed on the recording medium (a PPC paper 6200 manufactured by RICOH CO., LTD). The diameter of each dot 26 in the above whole black image was measured. In this case, the frequency of the pulses supplied to each heater element 11 was 48 kHz and the number of ink droplets for a single dot was controlled within a range of 1–6. That is, the dot forming frequency was 8 kHz. The result is shown in FIG. 16. FIG. 16 (*a*) shows dots 26 each being formed of one ink droplet and the diameter of each dot is 32.1 μm. FIG. 16 (*b*) shows dots 26 each being formed of two ink droplets and the diameter of each dot is 63.8 μm. FIG. 16 (*c*) shows dots 26 each being formed of three ink droplets and the diameter of each dot is 72.5 μm. FIG. 16 (*d*) shows dots 26 each being formed of four ink droplets and the diameter of each dot is 80.9 μm. FIG. 16 (*e*) shows dots 26 each being formed of five ink droplets and the diameter of each dot is 88.8 μm. FIG. 16 (*f*) shows dots 26 each being formed of six ink droplets and the diameter of each dot is 96.2 μm. In a case where the dots are overlapped as shown in FIG. 16 (*b*) to (*f*), it is difficult to measure the diameter of each dot. Thus, in this case, only one dot were formed on the recording medium and diameter of the dot formed on the recording medium was measured.

In a case where each dot is formed on one ink droplet, the amount of ink included in a single dot formed on the recording medium is small, so that the diameter $Dd_d$ of each dot is less than a value of $\sqrt{2} \cdot D_p$ and the adjacent dots are separated from each other as shown in FIG. 16 (*a*). In this case, a great amount of white space exists among dots, so that a gray image is formed on the recording medium. When the number of ink droplets for a single dot increases, the diameter of each dot increases and the white space among dots is decreased. As a result, the image becomes dark. In a case shown in FIG. 16 (*e*), the diameter $D_d$ of each dot is equal to the value $\sqrt{2} \cdot D_p$($D_d = \sqrt{2} \cdot D_p$) In this case, there is no white space among dots, so that a black image is obtained. Further, in a case shown in FIG. 16 (*f*), the diameter $D_d$ of each dot is greater than the value $\sqrt{2} \cdot D_p$($D_d > \sqrt{2} \cdot D_p$). In this case, the amount of area that adjacent dots are overlapped is further large, so that a more black image is obtained.

In a case where a half-tone image is formed by the normal ink jet recording head for forming a binary image, some dots must be removed from dots shown, for example, in FIG. 16 (*e*). Thus, the density in which dots are arranged are decreased, so that the resolution of the image deteriorates.

On the other hand, in the present invention, due to controlling the number of ink droplets forming each dot, a half-tone image is formed. Thus, the density at which dots are arranged is not decreased, so that the resolution of the image is not decreased and the image having a high quality is obtained.

What is claimed is:

1. An ink jet recording apparatus for jetting ink droplet to a recording medium and forming a dot image on said recording medium, said jet recording apparatus comprising:

ink jet orifices from which ink droplets are jetted;

ink spaces which are filled with ink and connected to said ink jetting orifices;

energy applying portions for applying energy to the ink in said ink spaces on demand so that ink droplets are jetted from said ink jetting orifices by the applied energy; and control means for controlling said energy applying portions in accordance with image information representing an image to be formed on said recording medium so that the image includes pixels each of which is formed of one or a plurality of ink droplets, a maximum number of ink droplets for each pixel being controlled so as to be less than ten, wherein an amount of ink for each pixel formed of one or a plurality of ink droplets is equal to or less than $1.405\times10^{-7}$ grams.

2. An ink jet recording apparatus for jetting ink droplets to a recording medium and forming a dot image on said recording medium, said ink jet recording apparatus comprising:

ink jet orifices from which ink droplets are jetted;

ink paths connected to said ink jetting orifices, said ink paths being filled with ink;

energy applying portions for applying energy to the ink in said ink paths on demand so that ink droplets are jetted from said ink jetting orifices by the applied energy; and control means for controlling said energy applying portions in accordance with image information representing an image to be formed on said recording medium so that the image includes pixels each of which is formed of one or a plurality of ink droplets, a maximum number of ink droplets for each pixel being controlled based on a kind of recording medium, wherein the maximum number of ink droplets for each pixel of the image depends on a kind of the recording medium on which the image is to be formed, and wherein a degree of expansion of an ink dot on the recording medium depends on the kind of the recording medium, a maximum number of ink droplets being controlled so as to be less than ten, wherein an amount of ink for each pixel formed of one or a plurality of ink droplets is equal to or less than $1.405\times10^{-7}$ grams.

3. An ink jet recording apparatus for jetting ink droplets to a recording medium and forming a dot image on said recording medium, said ink jet recording apparatus comprising:

ink jetting orifices from which ink droplets are jetted;

ink paths connected to said ink jetting orifices, said ink paths being filled with ink;

energy applying portions for applying energy to the ink in said ink paths on demand so that ink droplets are jetted from said ink jetting orifices by the applied energy; and control means for controlling said energy applying portions in accordance with image information representing an image to be formed on said recording medium so that the image includes pixels each of which is formed of one or a plurality of ink droplets, a maximum number of ink droplets for each pixel being controlled based on a kind of recording medium, wherein a center of each pixel which is formed of one or a plurality of ink droplets is approximately on a predetermined position on said recording medium, a maximum number of ink droplets being controlled so as to be less than ten, wherein an amount of ink for each pixel formed of one or a plurality of ink droplets is equal to or less than $1.405\times10^{-7}$ grams.

4. An ink jet recording apparatus for jetting ink droplets to a recording medium and forming a dot image on said recording medium, said ink jet recording apparatus comprising:

ink jetting orifices from which ink droplets are jetted;

ink paths connected to said ink jetting orifices, said ink paths being filled with ink;

energy applying portions for applying energy to the ink in said ink paths on demand so that ink droplets are jetted from said ink jetting orifices by the applied energy; and control means for controlling said energy applying portions in accordance with image information representing an image to be formed on said recording medium so that the image includes pixels each of which is formed of one or a plurality of ink droplets, a maximum number of ink droplets for each pixel being controlled based on a kind of recording medium, wherein pixels each of which are formed of one or a plurality of ink droplets are arranged at approximately constant intervals in the image, a maximum number of ink droplets being controlled so as to be less than ten, wherein an amount of ink for each pixel formed of one or a plurality of ink droplets is equal to or less than $1.405\times10^{-7}$ grams.

5. An ink jet recording apparatus for jetting ink droplets to a recording medium and forming a dot image on said recording medium, said ink jet recording apparatus comprising:

ink jetting orifices from which ink droplets are jetted;

ink paths connected to said ink jetting orifices, said ink paths being filled with ink;

energy applying portions for applying energy to the ink in said ink paths on demand so that ink droplets are jetted from said ink jetting orifices by the applied energy; and control means for controlling said energy applying portions in accordance with image information representing an image to be formed on said recording medium so that the image includes pixels each of which is formed of one or a plurality of ink droplets, a maximum number of ink droplets for each pixel being controlled based on a kind of recording medium, wherein a number of ink droplets corresponding to image data for a pixel is controlled so that a relationship between an actual density of the pixel in the image on said recording medium and the image data for the pixel is linear, a maximum number of ink droplets being controlled so as to be less than ten, wherein an amount of ink for each pixel formed of one or a plurality of ink droplets is equal to or less than $1.405\times10^{-7}$ grams.

* * * * *